US006219940B1

(12) United States Patent
Kita

(10) Patent No.: US 6,219,940 B1
(45) Date of Patent: Apr. 24, 2001

(54) ATHLETIC SHOE MIDSOLE DESIGN AND CONSTRUCTION

(75) Inventor: Kenjiro Kita, Osaka (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 09/314,366

(22) Filed: May 19, 1999

(30) Foreign Application Priority Data

May 22, 1998 (JP) ..... 10-158498

(51) Int. Cl.[7] ..... A43B 13/12

(52) U.S. Cl. ..... 36/30 R; 36/28; 36/31; 36/103

(58) Field of Search ..... 36/30 R, 44, 102, 36/114, 88, 92, 87, 760, 103, 25 R, 28, 29, 31, 32 R, 35 R, 37

(56) References Cited

U.S. PATENT DOCUMENTS

| | | | | |
|---|---|---|---|---|
| 623,549 | * | 4/1899 | Jaque | 36/44 |
| 1,050,807 | | 1/1913 | Chamberlain . | |
| 1,659,339 | * | 2/1928 | Vetterling | 36/28 |
| 2,364,134 | | 12/1944 | Dow et al. . | |
| 2,400,487 | | 5/1946 | Clark . | |
| 2,677,906 | | 5/1954 | Reed . | |
| 3,170,178 | * | 2/1965 | Scholl | 36/146 R |
| 4,071,963 | | 2/1978 | Fukuoka . | |
| 4,128,950 | | 12/1978 | Bowerman et al. . | |
| 4,356,642 | | 11/1982 | Herman . | |
| 4,364,186 | | 12/1982 | Fukuoka . | |
| 4,399,620 | | 8/1983 | Funck . | |
| 4,561,195 | * | 12/1985 | Onoda et al. | 36/30 R |
| 4,774,774 | | 10/1988 | Allen, Jr. . | |
| 4,798,010 | * | 1/1989 | Sugiyama | 36/30 R |
| 4,805,319 | | 2/1989 | Tonkel . | |
| 4,815,221 | | 3/1989 | Diaz . | |
| 4,864,737 | | 9/1989 | Marrello . | |
| 4,878,300 | | 11/1989 | Bogaty . | |
| 4,910,882 | | 3/1990 | Goeller . | |
| 4,930,232 | | 6/1990 | Engle . | |
| 4,999,931 | | 3/1991 | Vermeulen . | |
| 5,185,943 | | 2/1993 | Tong et al. . | |

(List continued on next page.)

FOREIGN PATENT DOCUMENTS

| | | |
|---|---|---|
| 196 41 866 | 12/1997 | (DE) . |
| 0092366 | 10/1983 | (EP) . |
| 0857434 | 8/1998 | (EP) . |
| 0878142 | 11/1998 | (EP) . |
| 2032760 | 5/1980 | (GB) . |
| 2114869 | 9/1983 | (GB) . |
| 61-6804 | 3/1986 | (JP) . |
| 11-203 | 1/1999 | (JP) . |
| WO90/06699 | 6/1990 | (WO) . |

*Primary Examiner*—Paul T. Sewell
*Assistant Examiner*—Jila M. Mohandesi
(74) *Attorney, Agent, or Firm*—W. F. Fasse; W. G. Fasse

(57) ABSTRACT

A midsole assembly for an athletic shoe includes a midsole and a corrugated sheet. The midsole is formed of soft elastic material. The corrugated sheet is disposed at least in the heel portion of the midsole. The front end of the corrugated sheet may extend from the plantar arch portion to the forefoot portion of the midsole. A sheet of fiber reinforced plastics or the like is bonded to the corrugated sheet and extends from the outer circumference portion of the heel portion to the plantar arch portion of the corrugated sheet or other cushioning. A meshed sheet portion having a lower modulus of elasticity than the corrugated sheet is formed in the center of the heel portion. Thus, lateral deformation of the shoes after contacting with the ground can be prevented at the outer circumference of the heel portion while providing a plantar arch portion having higher compressive hardness and improved running stability. The shock load on landing is absorbed at the heel central portion having lower compressive hardness, so that cushioning properties are improved.

50 Claims, 18 Drawing Sheets

U.S. PATENT DOCUMENTS

| | | | |
|---|---|---|---|
| 5,224,280 | 7/1993 | Preman et al. . | |
| 5,255,451 | 10/1993 | Tong et al. . | |
| 5,528,842 | 6/1996 | Ricci et al. . | |
| 5,606,807 | 3/1997 | Prepodnik . | |
| 5,720,118 | 2/1998 | Mayer et al. . | |
| 5,746,012 | 5/1998 | Caletti et al. . | |
| 5,799,415 | 9/1998 | Kenji et al. . | |
| 5,974,695 * | 11/1999 | Slepian et al. | 36/27 |

* cited by examiner

ATHLETIC SHOE MIDSOLE DESIGN AND CONSTRUCTION

CROSS-REFERENCE TO RELATED APPLICATIONS

The present application is related to the following copending U.S. applications of the same or overlapping inventors: Ser. No. 09/318,578 filed on May 25, 1999; issues 09/339,269 filed on Jun. 23, 1999 pending; Ser. No. 09/395,516 filed on Sep. 14, 1999 pending; and Ser. No. 09/437,918 filed on Nov. 10, 1999 pending.

BACKGROUND OF THE INVENTION

The present invention relates to an athletic shoe midsole design and construction. More particularly, the invention relates to a midsole assembly, which is comprised of a midsole formed of soft elastic material and a corrugated sheet disposed in the midsole.

The sole of an athletic shoe used in various sports is generally comprised of a midsole and an outsole, which is fitted under the midsole and directly contacts with the ground. The midsole is typically formed of soft elastic material in order to ensure adequate cushioning properties.

Generally, running stability as well as adequate cushioning properties are required in athletic shoes. There is a need to prevent shoes from being deformed excessively in the lateral or transverse direction when contacting the ground.

As shown in Japanese Utility Model Examined Publication No. 61-6804, the applicant of the present invention proposes a midsole assembly having a corrugated sheet therein, which can prevent such an excessive lateral deformation of shoes.

The midsole assembly shown in the above publication incorporates a corrugated sheet in a heel portion of a midsole and it can produce resistant force preventing the heel portion of a midsole from being deformed laterally or transversely when a shoe contacts with the ground. Thus, the transverse deformation of the heel portion of a shoe is prevented.

In such a way, by inserting a corrugated sheet into a midsole, the heel portion of a midsole tends to be less deformed in the transverse direction. When the corrugated sheet is formed especially of higher elastic material, that is, material having a higher modulus of elasticity, the heel portion of a midsole tends to be less deformed in the vertical direction as well. Therefore, by inserting a corrugated sheet, the heel portion of a midsole, where adequate cushioning properties are required, may undesirably show less cushioning properties in contacting the ground.

On the other hand, when a relatively lower elasticity material, that is, material having a lower modulus of elasticity, is used as a corrugated sheet, cushioning properties can be achieved to some degree at the time of contacting with the ground. In athletics such as tennis or basketball, however, where players move more often in the transverse direction, the transverse deformation of the heel portion of the shoes cannot be adequately restrained and running stability cannot be fully secured.

The object of the present invention is to provide a midsole assembly for an athletic shoe which can secure cushioning properties as well as the running stability.

SUMMARY OF THE INVENTION

The present invention provides a midsole assembly for an athletic shoe.

In one embodiment, a midsole assembly comprises a midsole formed of soft elastic material and a corrugated sheet disposed in the heel portion of a midsole. A higher elastic member having a modulus of elasticity that is greater than that of the corrugated sheet is placed along the outer circumference of the heel portion of the corrugated sheet. The term "higher elastic member" is uniformly used herein to refer to a member that has a modulus of elasticity that is higher relative to the modulus of elasticity of the corrugated sheet.

In a second embodiment, a midsole assembly comprises a midsole formed of soft elastic material and a corrugated sheet disposed in the heel portion of a midsole. A lower elastic portion having a modulus of elasticity that is lower than that of the corrugated sheet is placed in the heel central portion of the corrugated sheet. The terms "lower elastic portion" and "lower elastic member" are uniformly used herein to refer to a cushioning member or portion of the corrugated sheet that has a modulus of elasticity that is lower relative to the modulus of elasticity of the remainder of the corrugated sheet itself.

In a third embodiment, a midsole assembly comprises a midsole formed of soft elastic material and a corrugated sheet disposed in the heel portion of a midsole. A higher elastic member is provided along the outer circumference of the heel portion of the corrugated sheet and a lower elastic portion is placed in the heel central portion of the corrugated sheet.

A fourth embodiment provides a midsole assembly according to the first or third embodiment, wherein the higher elastic member comprises a fiber-reinforced plastic sheet.

A fifth embodiment provides a midsole assembly according to the first or third embodiment, wherein the higher elastic member comprises a metal plate.

A sixth embodiment a midsole assembly according to the first or third embodiment, wherein the higher elastic member is bonded to the corrugated sheet.

A seventh embodiment provides a midsole assembly according to the first or third embodiment, wherein the higher elastic member is injection molded together with the corrugated sheet.

An eighth embodiment provides a midsole assembly according to the second or third embodiment, wherein the lower elastic portion is comprised of a plurality of holes formed in the corrugated sheet.

A ninth embodiment provides a midsole assembly according to the second or third embodiment, wherein the lower elastic portion is comprised of a meshed sheet, which is injection molded together with the corrugated sheet.

A tenth embodiment provides a midsole assembly according to the second or third embodiment, wherein the lower elastic portion is comprised of titanium.

An eleventh embodiment provides a midsole assembly according to the second or third embodiment, wherein the lower elastic portion is comprised of superelastic material.

A twelfth embodiment provides a midsole assembly according to the tenth embodiment, wherein the titanium is insert molded together with the corrugated sheet.

A thirteenth embodiment provides a midsole assembly according to the twelfth embodiment, wherein the titanium is meshed, or comprised of a plurality of fibers or plates of titanium.

A fourteenth embodiment provides a midsole assembly according to the eleventh embodiment, wherein the superelastic material is insert molded together with the corrugated sheet.

A fifteenth embodiment provides a midsole assembly according to the fourteenth embodiment, wherein the superelastic material is meshed, or comprised of a plurality of fibers or plates of superelastic material.

In a sixteenth embodiment, a midsole assembly comprises a midsole formed of soft elastic material and a corrugated sheet disposed in the heel portion of a midsole. The front end of the corrugated sheet extends from the plantar arch portion to the forefoot portion of the midsole. A higher elastic member is placed from the outer circumference of the heel portion to the plantar arch portion of the corrugated sheet.

In a seventeenth embodiment, a midsole assembly comprises a midsole formed of soft elastic material and a corrugated sheet disposed in the heel portion of a midsole. The front end of the corrugated sheet extends from the plantar arch portion to the forefoot portion of the midsole and a lower elastic portion is provided in the heel central portion of the corrugated sheet.

In an eighteenth embodiment, a midsole assembly comprises a midsole formed of soft elastic material and a corrugated sheet disposed in the heel portion of a midsole. The front end of the corrugated sheet extends from the plantar arch portion to the forefoot portion of the midsole. A higher elastic member is placed from the outer circumference of the heel portion to the plantar arch portion of the corrugated sheet and a lower elastic portion is provided in the heel central portion of the corrugated sheet.

A nineteenth embodiment provides a midsole assembly according to the sixteenth or eighteenth embodiment, wherein the higher elastic member comprises a fiber reinforced plastic sheet.

A twentieth embodiment provides a midsole assembly according to the sixteenth or eighteenth embodiment, wherein the higher elastic member comprises a metal plate.

A twenty-first embodiment provides a midsole assembly according to the sixteenth or eighteenth embodiment, wherein the higher elastic member is bonded to the corrugated sheet.

A twenty-second embodiment provides a midsole assembly according to the sixteenth or eighteenth embodiment, wherein the higher elastic member is injection molded together with the corrugated sheet.

A twenty-third embodiment provides a midsole assembly according to the seventeenth or eighteenth embodiment, wherein the lower elastic portion is comprised of a plurality of holes formed in the corrugated sheet.

A twenty-fourth embodiment provides a midsole assembly according to the seventeenth or eighteenth embodiment, wherein the lower elastic portion is comprised of a meshed sheet, which is injection molded together with the corrugated sheet.

A twenty-fifth embodiment provides a midsole assembly according to the seventeenth or eighteenth embodiment, wherein the lower elastic portion is comprised of titanium.

A twenty-sixth embodiment provides a midsole assembly according to the seventeenth or eighteenth embodiment, wherein the lower elastic portion is comprised of superelastic material.

A twenty-seventh embodiment provides a midsole assembly according to the twenty-fifth embodiment, wherein the titanium is insert molded together with the corrugated sheet.

A twenty-eighth embodiment provides a midsole assembly according to the twenty-seventh embodiment, wherein the titanium is meshed, or comprised of a plurality of fibers or plates of titanium.

A twenty-ninth embodiment provides a midsole assembly according to the twenty-sixth embodiment, wherein the superelastic material is insert molded together with the corrugated sheet.

A thirtieth embodiment provides a midsole assembly according to the twenty-ninth embodiment, wherein the superelastic material is meshed, or comprised of a plurality of fibers or plates of superelastic material.

In a thirty-first embodiment, a midsole assembly comprises a midsole formed of soft elastic material and a corrugated sheet disposed in the heel portion of a midsole. The front end of the corrugated sheet extends from the plantar arch portion to the forefoot portion of the midsole and a lower elastic portion is provided at the forefoot portion of the corrugated sheet.

A thirty-second embodiment provides a midsole assembly according to the thirty-first embodiment, wherein the lower elastic portion is comprised of a plurality of holes formed in the corrugated sheet.

A thirty-third embodiment provides a midsole assembly according to the thirty-first embodiment, wherein the lower elastic portion is comprised of a meshed sheet, which is injection molded together with the corrugated sheet.

A thirty-fourth embodiment provides a midsole assembly according to the thirty-first embodiment, wherein the lower elastic portion is comprised of titanium.

A thirty-fifth embodiment provides a midsole assembly according to the thirty-first embodiment, wherein the lower elastic portion is comprised of superelastic material.

A thirty-sixth embodiment provides a midsole assembly according to the thirty-fourth or thirty-fifth embodiment, wherein the titanium or superelastic material is insert molded together with the corrugated sheet.

A thirty-seventh embodiment provides a midsole assembly according to the thirty-sixth embodiment, wherein the titanium or superelastic material is meshed, or comprised of a plurality of fibers or plates of titanium or superelastic material.

A thirty-eighth embodiment provides a midsole assembly according to the thirty-first embodiment, wherein the forefoot portion of the corrugated sheet includes a laterally extending groove.

In a thirty-ninth embodiment, a midsole assembly comprises a midsole formed of soft elastic material and a corrugated sheet disposed in the heel portion of a midsole. The front end of the corrugated sheet extends from the plantar arch portion to the forefoot portion of the midsole and a higher elastic member is placed at the plantar arch portion of the corrugated sheet.

A fortieth embodiment provides a midsole assembly according to the thirty-ninth embodiment, wherein the higher elastic member comprises a fiber reinforced plastic sheet.

A forty-first embodiment provides a midsole assembly according to the thirty-ninth embodiment, wherein the higher elastic member comprises a metal plate.

A forty-second embodiment provides a midsole assembly according to the thirty-ninth embodiment, wherein the higher elastic member is bonded to the corrugated sheet.

A forty-third embodiment provides a midsole assembly according to the thirty-ninth embodiment, wherein the higher elastic member is injection molded together with the corrugated sheet.

A forty-fourth embodiment provides a midsole assembly according to the thirty-ninth embodiment, wherein the higher elastic member extends in a band shape in the longitudinal direction of the plantar arch portion.

A forty-fifth embodiment provides a midsole assembly according to the thirty-ninth embodiment, wherein the higher elastic member covers the plantar arch portion.

In the first embodiment, a corrugated sheet is disposed in the heel portion of a midsole and a higher elastic member is placed along the outer circumference of the heel portion of the corrugated sheet.

Thus, a compressive hardness (or hardness to deform against the compressive force) is made higher along the outer circumference of the heel portion, and as a result, transverse deformation of shoes after landing can be prevented and running stability can be ensured even in sports in which athletes move more often in the transverse direction. Moreover, since the heel portion of a foot can be restrained from sinking unnecessarily into the midsole, loss of athletic power is lessened.

Furthermore, flexibility of the midsole is maintained to some degree in the heel central portion, which has a relatively low compressive hardness as compared to the outer circumference of the heel portion. Therefore, cushioning properties can be ensured in this heel central portion.

Additionally, in this case, when a material of relatively low elasticity is used as a corrugated sheet, more flexibility of the heel central portion of the midsole can be acquired and cushioning properties can be improved.

In the second embodiment, a lower elastic portion is provided in the heel central portion of the corrugated sheet.

Thus, a compressive hardness of the midsole is made lower at the heel central portion, and as a result, flexibility of the midsole is maintained and cushioning properties at landing can be improved.

Moreover, because a compressive hardness of the midsole is relatively high along the outer circumference of the heel portion, which has a relatively high compressive hardness as compared to the heel central portion, transverse deformation of the shoes can be prevented and the running stability can be ensured.

In the third embodiment, a higher elastic member is placed along the outer circumference of the heel portion of the corrugated sheet, and a lower elastic portion is placed in the heel central portion of the corrugated sheet.

Thus, transverse deformation after landing can be prevented at the outer circumference of the heel portion, which has a comparatively high compressive hardness, and cushioning properties on landing can be ensured at the heel central portion of a relatively low compressive hardness.

In the fourth embodiment, the higher elastic member comprises a fiber-reinforced plastic sheet. The fiber reinforced plastics (FRP) is comprised of reinforcement fiber and matrix resin. The reinforcement fiber may be carbon fiber, aramid fiber, glass fiber and the like. The matrix resin may be thermoplastic or thermosetting resin.

In the fifth embodiment, the higher elastic member comprises a metal plate. This plate is made of metals such as SUS (or stainless steel), superelastic alloy, or the like.

The higher elastic member may be bonded to the corrugated sheet, as described in the sixth embodiment. Alternatively, the higher elastic member may be injection molded together with the corrugated sheet, as described in the seventh embodiment.

The lower elastic portion may be comprised of a plurality of holes formed in the corrugated sheet, as described in the eighth embodiment. Alternatively, the lower elastic portion may be comprised of a meshed sheet, which is injection molded together with the corrugated sheet, as described in the ninth embodiment.

The lower elastic portion may be comprised of titanium itself or superelastic material itself, as described in the tenth or eleventh embodiment, respectively. In this case, a higher impact resilience and a lighter weight can be achieved.

The titanium or superelastic material may be insert molded together with the corrugated sheet, as described in the twelfth or fourteenth embodiment. Further, titanium or superelastic material may be meshed, or comprised of a plurality of fibers or plates of titanium or superelastic material, as described in the thirteenth or fifteenth embodiment.

In the sixteenth embodiment, the front end of the corrugated sheet extends from the plantar arch portion to the forefoot portion of the midsole, and a higher elastic member is placed from the outer circumference of the heel portion to the plantar arch portion of the corrugated sheet.

Thus, after landing, the heel portion to the plantar arch portion of the midsole can be prevented from deforming transversely and the running stability can be ensured. Moreover, cushioning properties on landing can be ensured at the heel central portion of a relatively low compressive hardness.

In the seventeenth embodiment, the front end of the corrugated sheet extends from the plantar arch portion to the forefoot portion of the midsole, and a lower elastic portion is provided in the heel central portion of the corrugated sheet.

Thus, flexibility of the midsole is maintained at the heel central portion, which has a lower compressive hardness, and the cushioning properties at the time of landing can be improved. In addition, since the compressive hardness of the midsole is relatively high at the outer circumference of the heel portion, transverse deformation of the shoes after landing can be prevented and running stability can be ensured.

In the eighteenth embodiment, the front end of the corrugated sheet extends from the plantar arch portion to the forefoot portion of the midsole. A higher elastic member is placed from the outer circumferential portion of the heel portion to the plantar arch portion of the corrugated sheet, and a lower elastic portion is provided in the heel central portion of the corrugated sheet.

In this case, lateral deformation of shoes after landing can be prevented at both the outer circumference of the heel portion and the plantar arch portion, and the cushioning properties on landing can be ensured at the heel central portion.

The higher elastic member may be comprised of a fiber reinforced plastic sheet, as described in the nineteenth embodiment. In the alternative, the higher elastic member may be comprised of a metal plate, as described in the twentieth embodiment.

The higher elastic member may be bonded to the corrugated sheet, as described in the twenty-first embodiment, or it may be injection molded together with the corrugated sheet, as described in the twenty-second embodiment.

The lower elastic portion may be comprised of a plurality of holes formed in the corrugated sheet, as described in the twenty-third embodiment, or it may be comprised of a meshed sheet, which is injection molded together with the corrugated sheet, as described in the twenty-fourth embodiment.

The lower elastic portion may be comprised of titanium itself or superelastic material itself, as described in the twenty-fifth or twenty-sixth embodiment, respectively. In this case, a higher impact resilience and a lighter weight can be achieved.

The titanium or superelastic material may be insert molded together with the corrugated sheet, as described in the twenty-seventh or twenty-ninth embodiment. Further, titanium or superelastic material may be meshed, or comprised of a plurality of fibers or plates of titanium or superelastic material, as described in the twenty-eighth or thirtieth embodiment.

In the thirty-first embodiment, the front end of the corrugated sheet extends from the plantar arch portion to the forefoot portion of the midsole, and a lower elastic portion is provided at the forefoot portion of the corrugated sheet.

Thus, compressive hardness of the forefoot portion decreases and as a result, cushioning properties of the forefoot portion are maintained. Moreover, flexibility of the forefoot portion can be ensured and turnability of the forefoot portion is improved.

In addition, the forefoot portion of the corrugated sheet may be comprised of a plurality of holes formed in the corrugated sheet, as described in the thirty-second embodiment, or it may be comprised of a meshed sheet, which is injection molded together with the corrugated sheet, as described in the thirty-third embodiment.

The lower elastic portion may be comprised of titanium itself or superelastic material itself, as described in the thirty-fourth or thirty-fifth embodiment, respectively. In this case, a higher impact resilience and a lighter weight can be achieved.

The titanium or superelastic material may be insert molded together with the corrugated sheet, as described in the thirty-sixth embodiment. Further, titanium or superelastic material may be meshed, or comprised of a plurality of fibers or plates of titanium or superelastic material, as described in the thirty-seventh embodiment.

The forefoot portion of the corrugated sheet may include a laterally extending groove, as described in the thirty-eighth embodiment. In this case, flexibility of the forefoot portion of the midsole can be further improved.

In the thirty-ninth embodiment, the front end of the corrugated sheet extends from the plantar arch portion to the forefoot portion of the midsole, and a higher elastic member is located at the plantar arch portion of the corrugated sheet. Thus a, so-called "shank effect" can be developed and rigidity of the plantar arch portion can be improved. Asaresult, after landing, transverse deformation of the plantar arch portion of the midsole can be prevented and running stability can be ensured.

The higher elastic member may comprise a fiber reinforced plastic sheet, as described in the fortieth embodiment. Alternatively, the higher elastic member may comprise a metal plate, as described in the forty-first embodiment.

In addition, the higher elastic member may be bonded to the corrugated sheet, as described in the forty-second embodiment, or it may be injection molded together with the corrugated sheet, as described in the forty-third embodiment.

Furthermore, the higher elastic member may extend in the band shape in the longitudinal direction of the plantar arch portion, as described in the forty-fourth embodiment, or it may cover the plantar arch portion, as described in the forty-fifth embodiment.

BRIEF DESCRIPTION OF THE DRAWINGS

For a more complete understanding of the invention, reference should be made to the embodiments illustrated in greater detail in the accompanying drawings and described below by way of examples of the invention. In the drawings, which are not to scale:

FIG. 2A is a top plan view of the midsole construction of a left side shoe; and FIG. 2B is an inside side view thereof.

FIG. 3A is a top plan view of the midsole construction of a left side shoe; and FIG. 3B is an inside side view thereof.

FIG. 4A is a top plan view of the midsole construction of a left side shoe; and FIG. 4B is an inside side view thereof.

DETAILED DESCRIPTION OF THE PREFERRED EMBODIMENTS

Figure 1:
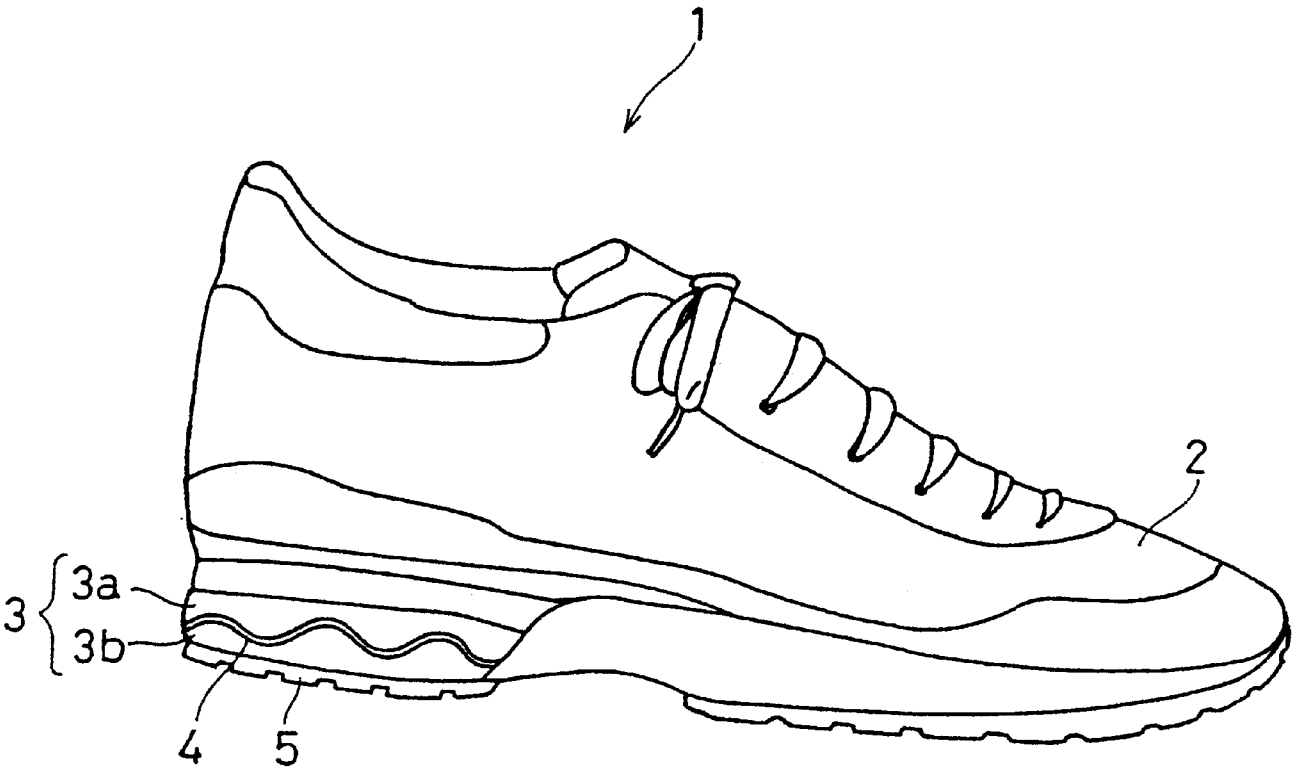
FIG. 1 a side view of an athletic shoe incorporating the midsole construction of the present invention.

Turning now to the drawings, FIG. 1 illustrates an athletic shoe incorporating a midsole construction of the present invention. The sole of this athletic shoe 1 comprises a midsole 3, a corrugated sheet 4 and an outsole 5 directly contacting with the ground. The midsole 3 is fitted to the bottom of the uppers 2. The corrugated sheet 4 is disposed in the midsole 3. The outsole 5 is fitted to the bottom of the midsole 3.

The midsole 3 is provided in order to absorb a shock load imparted on the bottom portion of the shoe 1 when an athlete lands on the ground. The midsole 3 is comprised of an upper midsole 3*a* and a lower midsole 3*b*, which are respectively disposed on the top and bottom surfaces of the corrugated sheet 4.

The midsole 3 is generally formed of soft elastic material having good cushioning properties. Specifically, thermoplastic synthetic resin foam such as ethylene-vinyl acetate copolymer (EVA), thermosetting resin foam such as polyurethane (PU), or rubber material foam such as butadiene or chloroprene rubber are used.

The corrugated sheet 4 is formed of thermoplastic resin such as thermoplastic polyurethane (TPU) of comparatively rich elasticity, polyamide elastomer (PAE), ABS resin and the like. Alternatively, the corrugated sheet 4 is formed of thermosetting resin such as epoxy resin, unsaturated polyester resin and the like.

Referring to FIGS. 2–14, there are shown various kinds of midsole constructions of the present invention.

In the following embodiments, the same reference numerals indicate the same or corresponding portions. In the first to third embodiments, the corrugated sheet 4 is placed only at the heel portion of the midsole 3. In the other embodiments, the corrugated sheet 4 is placed at the heel portion of the midsole 3 and the front end of the corrugated sheet 4 extends from the plantar arch portion to the forefoot portion of the midsole 3. Additionally, the following drawings show the left side shoe midsole construction.

Figure 2A:
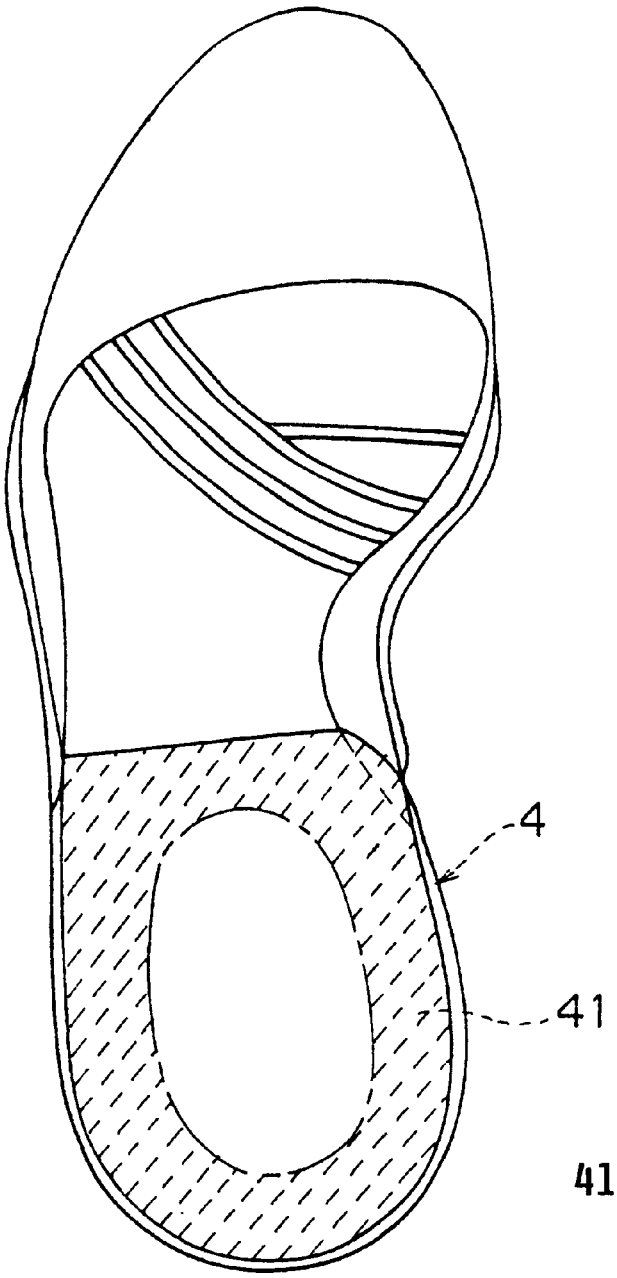
FIGS. 2A and 2B are schematics illustrating the midsole construction of the first embodiment of the present invention.
Figure 2B:
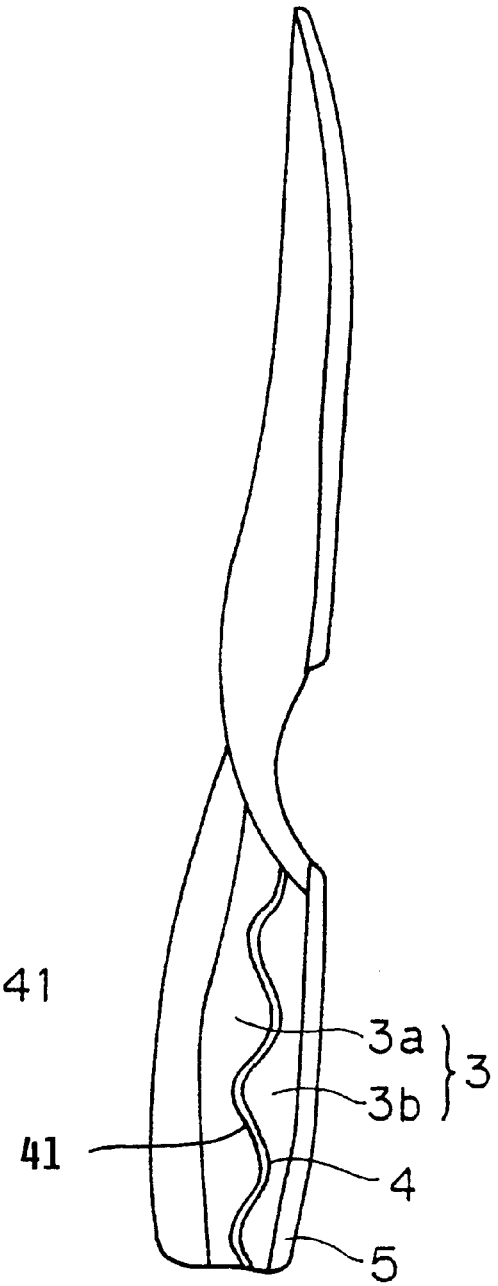

FIGS. 2A and 2B show the first embodiment of the present invention. In the drawing, FIG. 2A is a top plan view of the midsole construction, and FIG. 2B is an inner side view of the midsole construction.

In this first embodiment, a fiber reinforced plastic sheet 41 is provided along the outer circumference of the heel portion of the corrugated sheet 4. This fiber reinforced plastic sheet 41 is formed of fiber reinforced plastics (FRP), which is comprised of reinforcement fiber and matrix resin. The reinforcement fiber may be carbon fiber, aramid fiber, glass fiber or the like. The matrix resin may be thermoplastic or thermosetting resin.

Thus, a compressive hardness (or hardness to deform against a compressive force) of the midsole 3 is greater at the outer circumference of the heel portion, and as a result, even in sports in which athletes move more frequently in the transverse direction, the transverse deformation of the shoes after landing can be prevented and running stability can be secured. Moreover, since the unnecessary sinking of the heel of a foot into the midsole 3 can be restrained, loss of the athletic power is decreased.

On the other hand, flexibility of the midsole 3 is maintained to some degree in the heel central portion, which has a relatively low compressive hardness as compared to the outer circumference of the heel portion. Thereby, cushioning properties on landing are maintained at this heel central portion.

Additionally, in this case, when a relatively low elastic material is used as a corrugated sheet 4, the heel central portion of the midsole 3 is made more flexible and the cushioning properties can be improved.

The fiber reinforced plastic sheet 41 may be bonded to the corrugated sheet 4, or it may be injection molded together with the corrugated sheet 4.

Alternatively, a metal plate, which is made of stainless steel (SUS), superelastic alloy or the like, may be substituted for the fiber reinforced plastic sheet 41. Moreover, a sheet formed of other plastic materials may be utilized if it is a higher elastic member (or it has a larger modulus of elasticity) than the corrugated sheet 4.

Figure 3A:
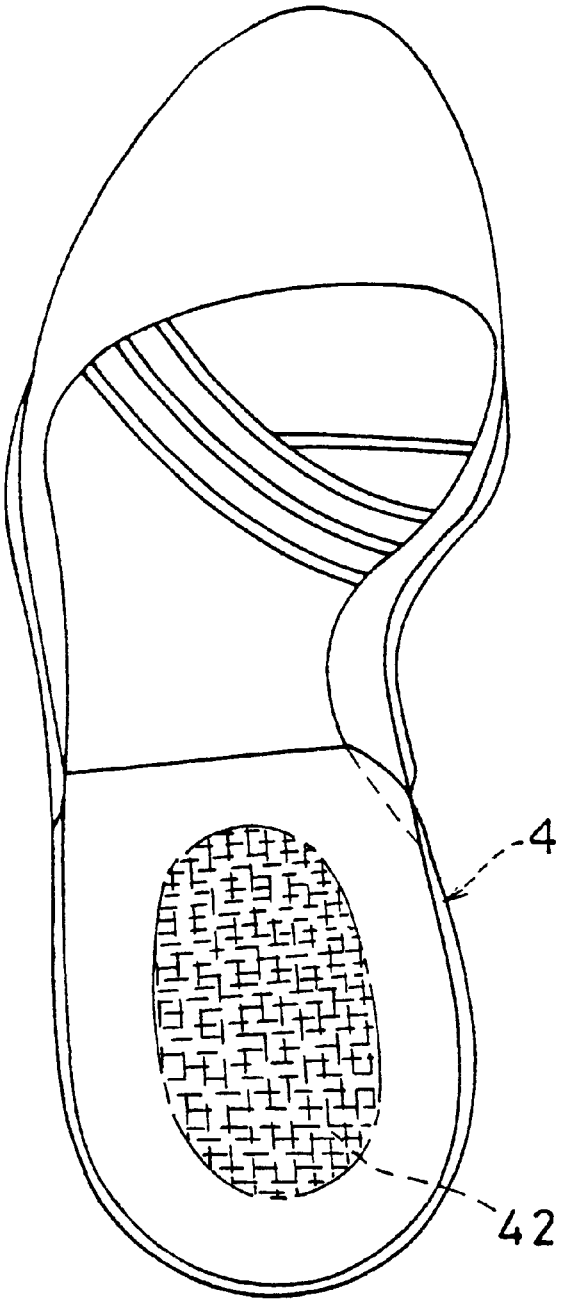
FIGS. 3A and 3B are schematics illustrating the midsole construction of the second embodiment of the present invention.
Figure 3B:
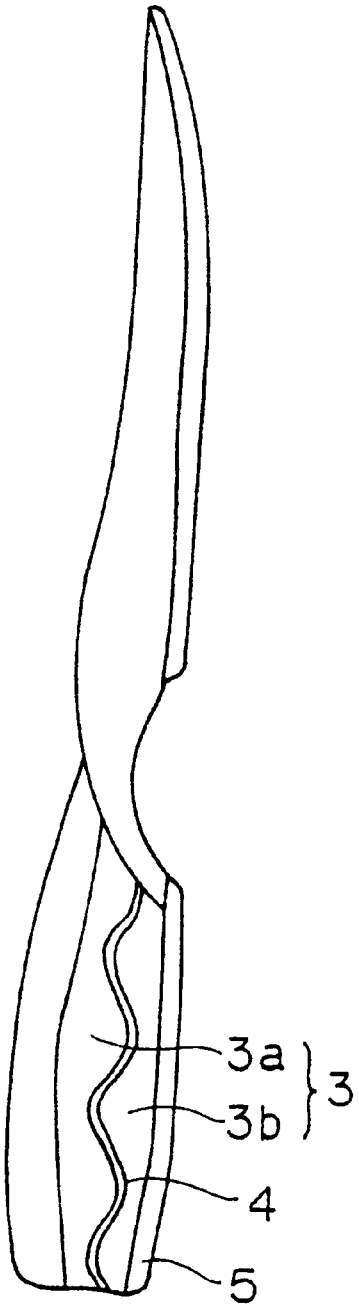

FIGS. 3A and 3B shown the midsole construction of the second embodiment of the present invention. In the drawing, FIG. 3A is a top plan view of the midsole construction, and FIG. 3B is an inner side view of the midsole construction.

In this second embodiment, a plurality of holes are formed in the heel central portion of the corrugated sheet 4 and the heel central portion is meshed.

This meshed portion 42 decreases the compressive hardness of the heel central portion of the midsole 3, and thus, flexibility of the midsole 3 is maintained and cushioning properties on landing can be increased.

On the other hand, the outer circumference of the heel portion of the midsole 3 has a relatively high compressive hardness as compared to the heel central portion and it can prevent a shoe from deforming transversely and ensure the running stability.

The shape of the holes formed in the heel central portion may be circular, rectangular, slit or any other configuration.

Moreover, a meshed portion 42 is not limited to a plurality of holes formed in the heel central portion of the corrugated sheet 4. A meshed portion 42 may be formed by injection molding a corrugated sheet 4 together with a meshed sheet that is formed in another process. Alternatively, a meshed portion 42 may be formed by using a relatively low elasticity (low modulus of elasticity) material relative to the corrugated sheet 4.

Figure 4A:
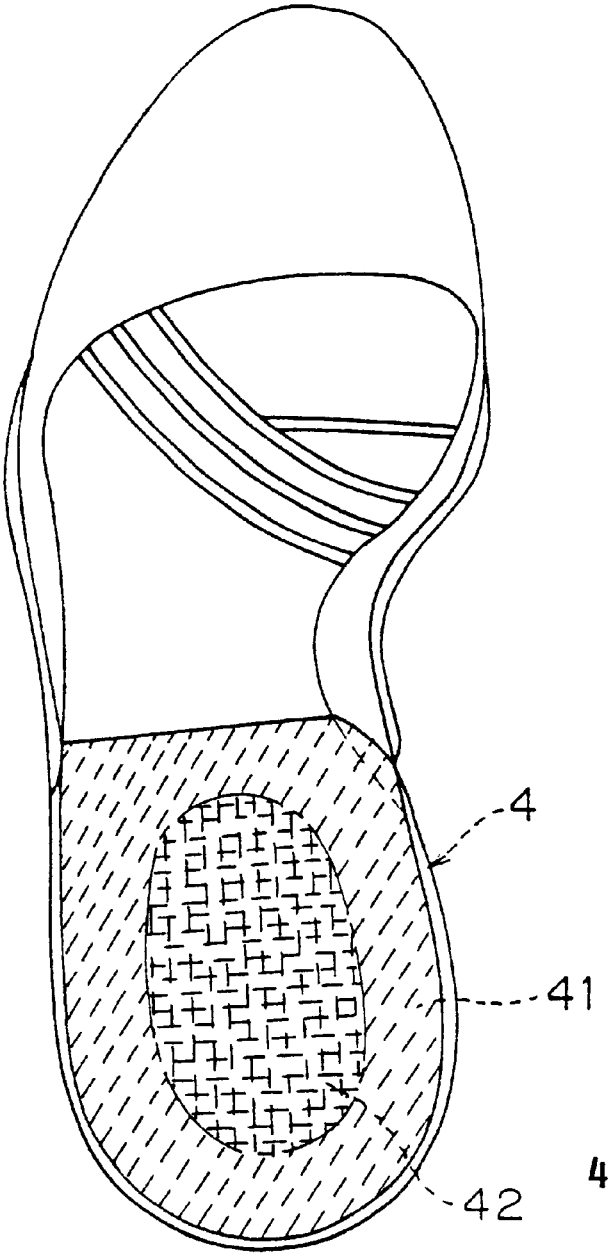
FIGS. 4A and 4B are schematics illustrating the midsole construction of the third embodiment of the present invention.
Figure 4B:
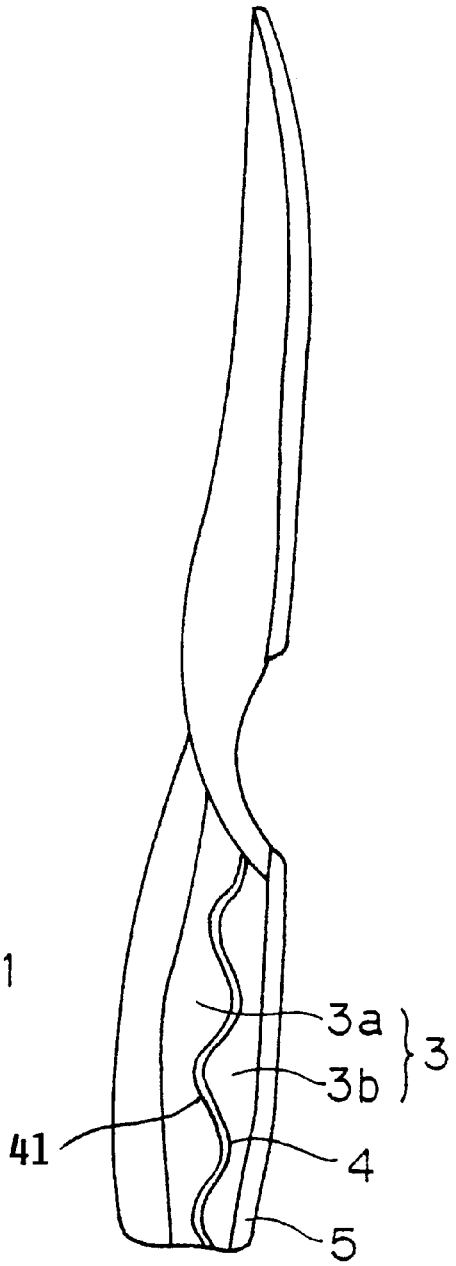

FIGS. 4A and 4B show the midsole construction of the third embodiment of the present invention. In the drawing, FIG. 4A is a top plan view of the midsole construction and FIG. 4B is an inside side view of the midsole construction.

In this third embodiment, a fiber reinforced plastic sheet 41 is disposed along the outer circumference of the heel portion of the corrugated sheet 4, and a plurality of holes are formed in the heel central portion of the corrugated sheet 4 and the heel central portion is thus meshed 42.

By employing such a structure, transverse deformation on landing can be prevented at the outer circumference of the heel portion having a large compressive hardness and cushioning properties on landing can be secured at the heel central portion having a small compressive hardness.

Figure 5:
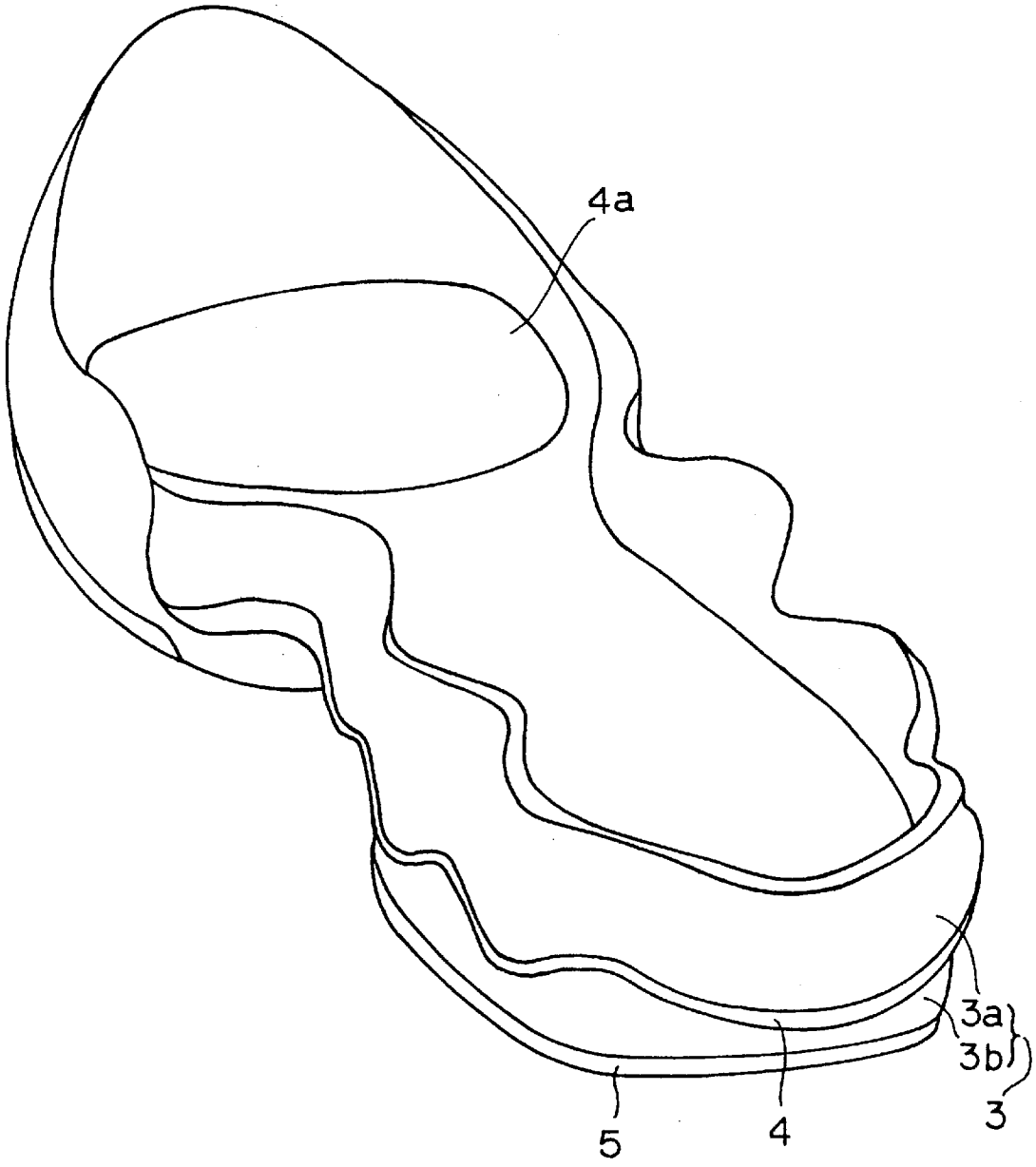
FIG. 5 is a perspective view of the left side midsole construction of the fourth embodiment of the present invention.
Figure 6:
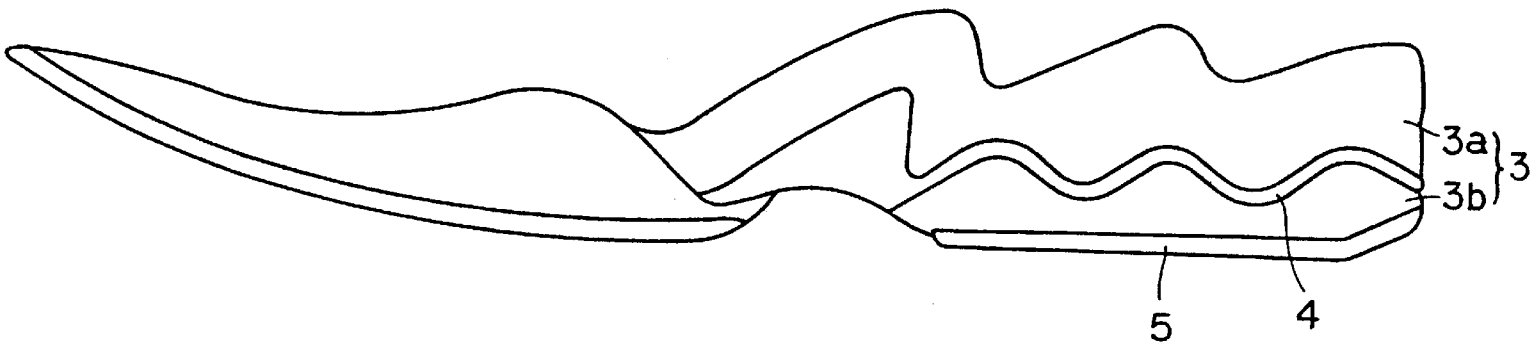
FIG. 6 is an outside side view of the left side midsole construction of the fourth embodiment of the present invention.
Figure 7:
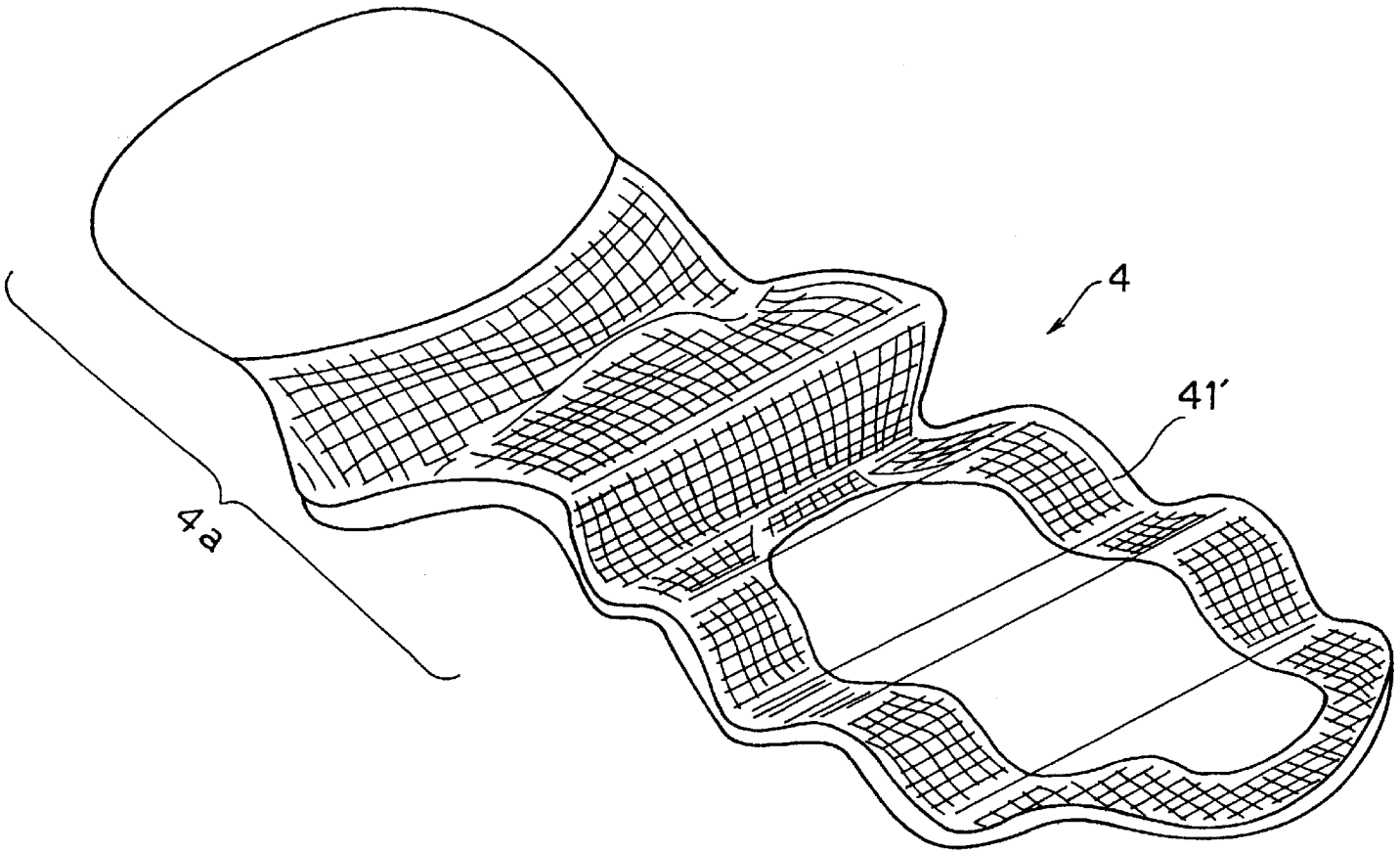
FIG. 7 is a perspective view of a corrugated sheet in the left side midsole construction of the fourth embodiment of the present invention.

FIGS. 5 to 7 show the midsole construction of the fourth embodiment of the present invention. FIG. 5 is a perspective view of the midsole construction, FIG. 6 is an outside side view of the midsole construction, and FIG. 7 is a perspective view of a corrugated sheet.

In this fourth embodiment, the front end portion 4*a* of the corrugated sheet 4 extends from the plantar arch portion to the forefoot portion of the midsole 3. The fiber reinforced plastic sheet 41' is placed at the outer circumference of the heel portion and from the outer circumference to the forefoot portion of the midsole 3.

Thus, after landing, transverse deformation of the heel portion to the plantar arch portion of the midsole 3 can be prevented and running stability can be ensured. Also, cushioning properties on landing can be ensured at the heel central portion having a relatively small compressive hardness.

The fiber reinforced plastic sheet 41' may be bonded to the corrugated sheet 4, or it may be injection molded together with the corrugated sheet 4.

Moreover, a metal plate made of stainless steel (SUS) or superelastic alloy can be substituted for the fiber reinforced plastic sheet 41'. Furthermore, a sheet formed of other plastic materials may be employed if it is a higher elasticity member than the corrugated sheet 4.

Figure 8:
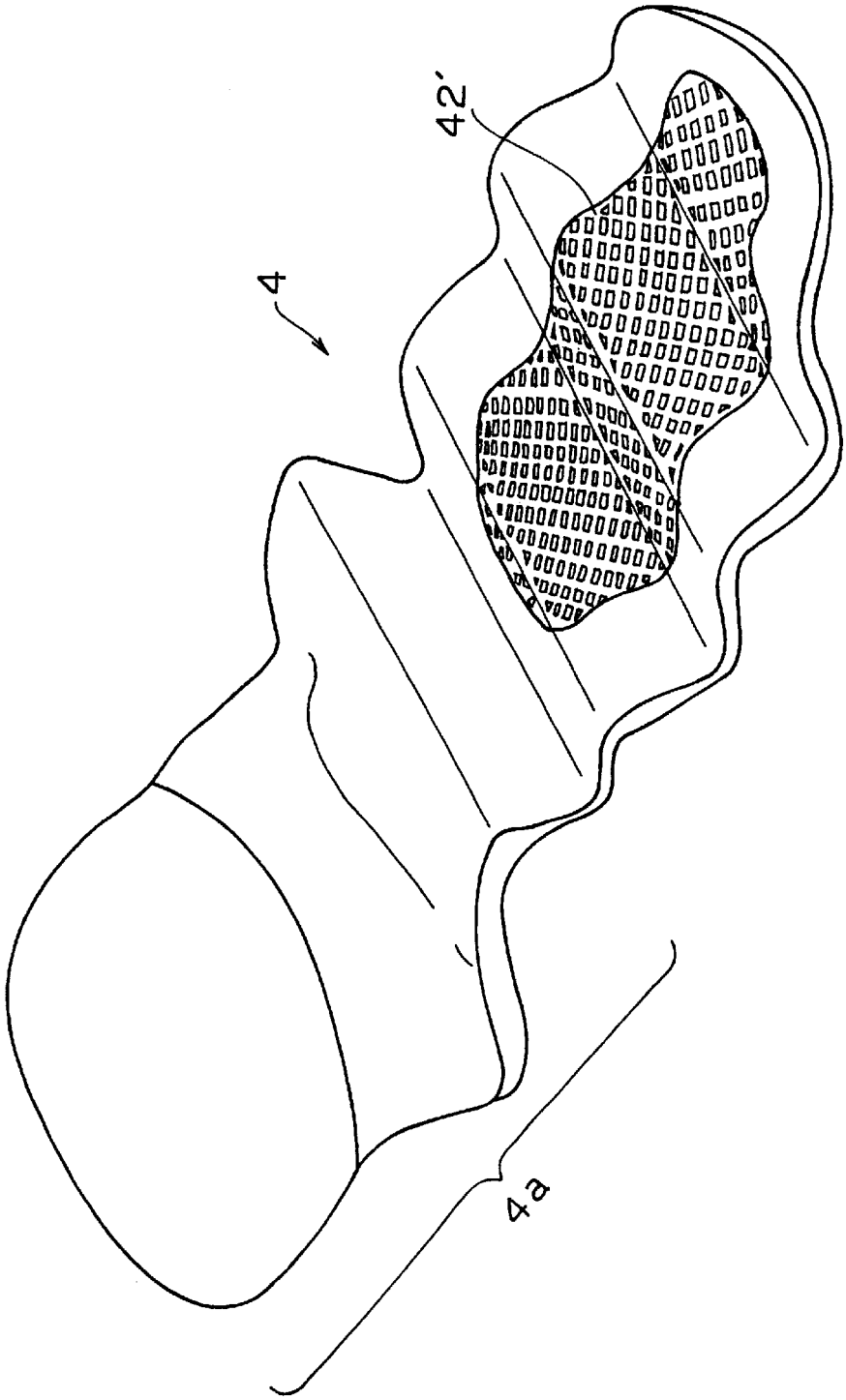
FIG. 8 is a perspective view of a corrugated sheet in the midsole construction of the fifth embodiment of the present invention.

FIG. 8 shows a corrugated sheet that is applied to the midsole construction of the fifth embodiment of the present invention.

In this fifth embodiment, the front end portion 4*a* of the corrugated sheet 4 extends from the plantar arch portion to the forefoot portion of the midsole 3, and a plurality of holes are formed in the heel central portion of the corrugated sheet and thereby the heel central portion is meshed. By forming this meshed portion 42', cushioning properties on landing can be secured at the heel central portion with a lower compressive hardness.

On the other hand, since compressive hardness of the midsole at the outer circumference of the heel portion is relatively large as compared to the heel central portion, transverse deformation of the shoe after landing can be prevented and running stability can be ensured at this outer circumference of the heel portion.

In addition, holes formed in the heel central portion of the corrugated sheet 4 may be circular, rectangular, slit or any other configuration.

Moreover, to provide a meshed portion 42', the corrugated sheet 4 may be injection molded together with a meshed sheet formed in a different process, instead of providing a plurality of holes. Furthermore, the meshed portion 42' may be formed by using a lower elastic member than the corrugated sheet 4.

Figure 9:
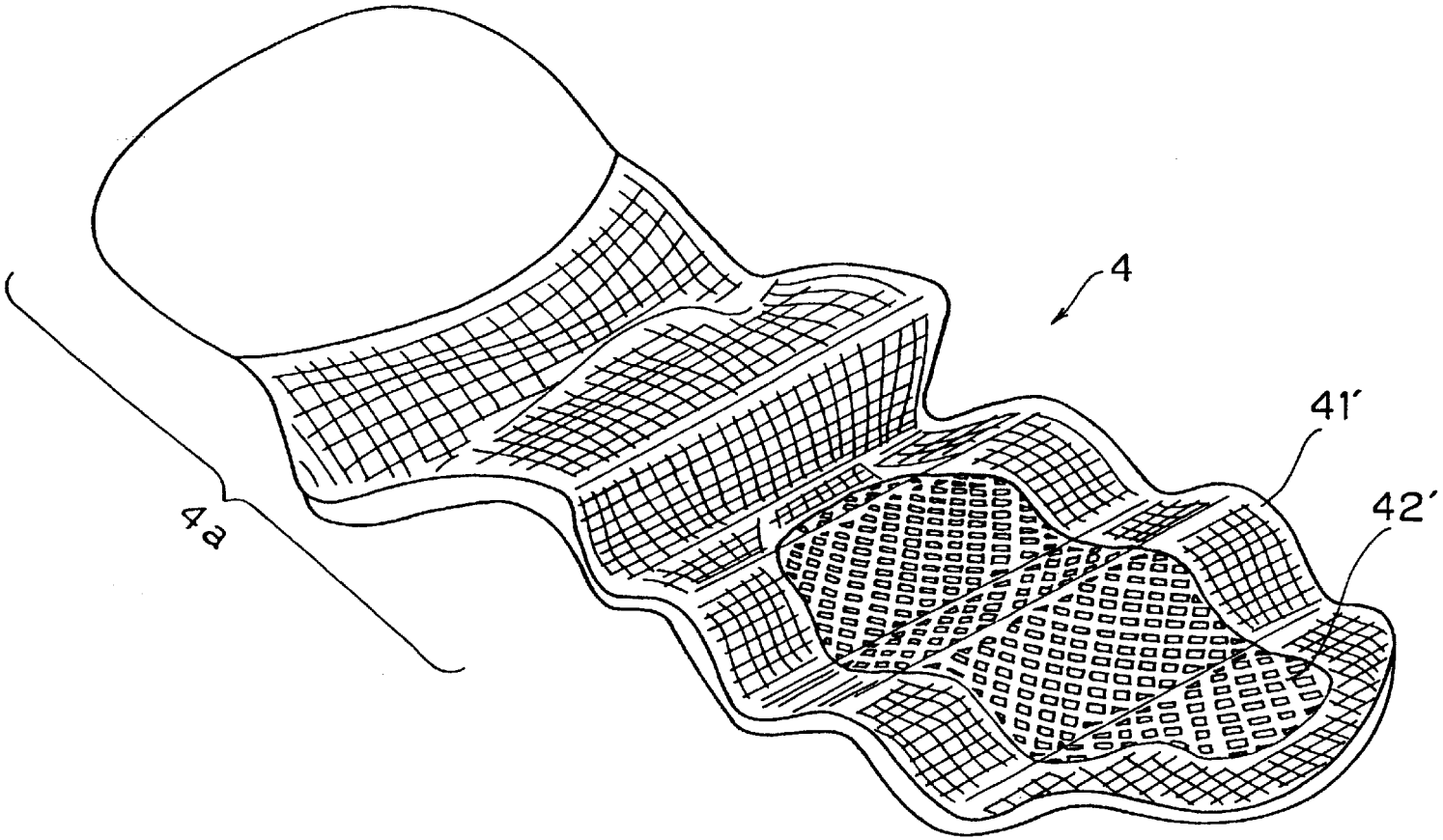
FIG. 9 is a perspective view of a corrugated sheet in the midsole construction of the sixth embodiment of the present invention.

FIG. 9 shows the midsole construction of the sixth embodiment of the present invention. In this sixth embodiment, the front end portion 4*a* of the corrugated sheet 4 extends from the plantar arch portion to the forefoot portion of the midsole 3, and a fiber reinforced plastic sheet 41' is fitted to the outer circumference of the heel portion and from the outer circumference of the heel portion to the plantar arch portion of the corrugated sheet 4. Moreover, the heel central portion of the corrugated sheet 4 is meshed 42'.

By forming or providing the sheet 41' and meshed portion 42', transverse deformation of the shoe on landing can be prevented at the outer circumference of the heel portion and plantar arch portion with higher compressive hardness, and cushioning properties on landing can be ensured at the heel central portion with a lower compressive hardness.

Figure 10:
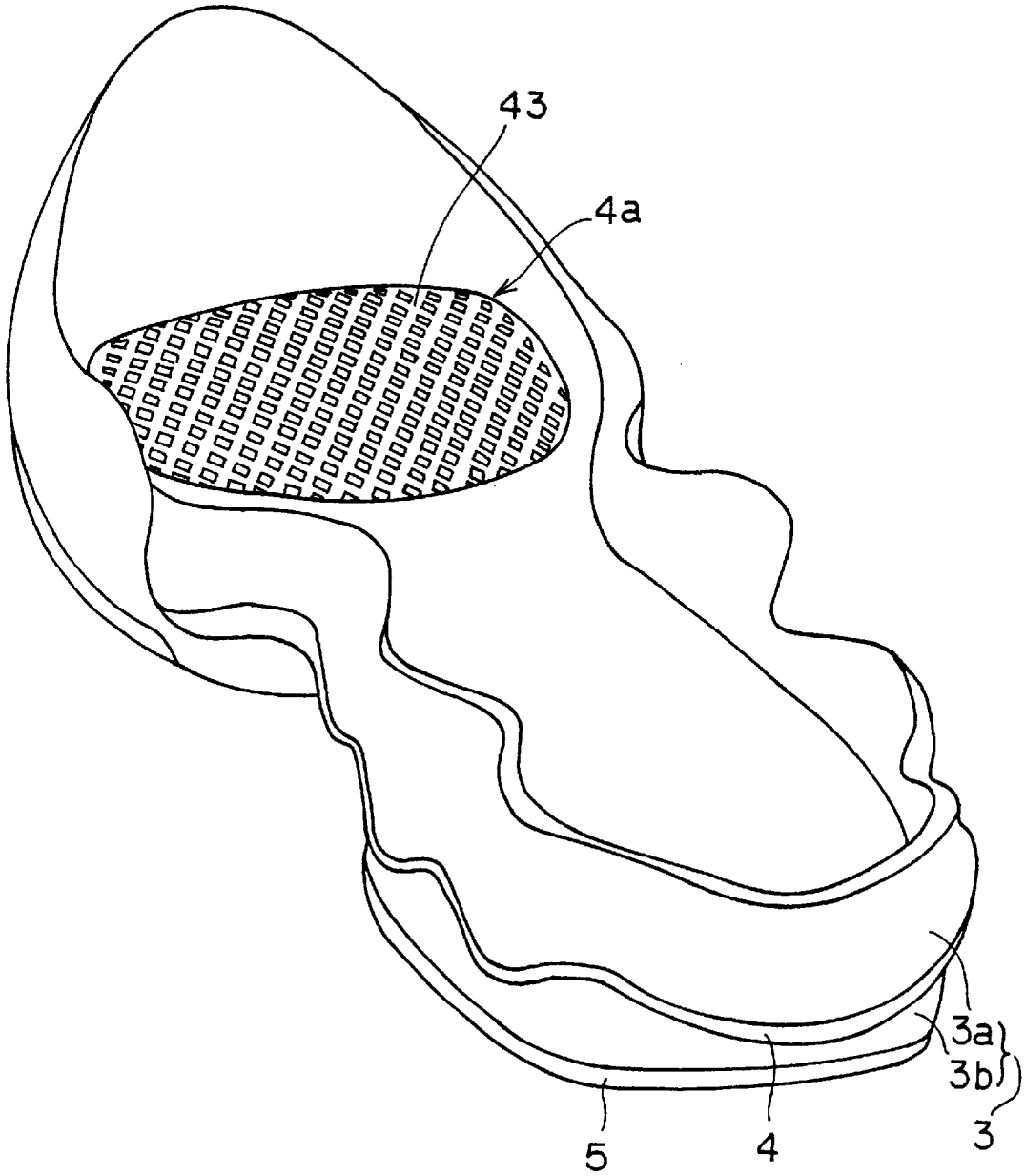
FIG. 10 is a perspective view of the midsole construction of the seventh embodiment of the present invention.
Figure 11:
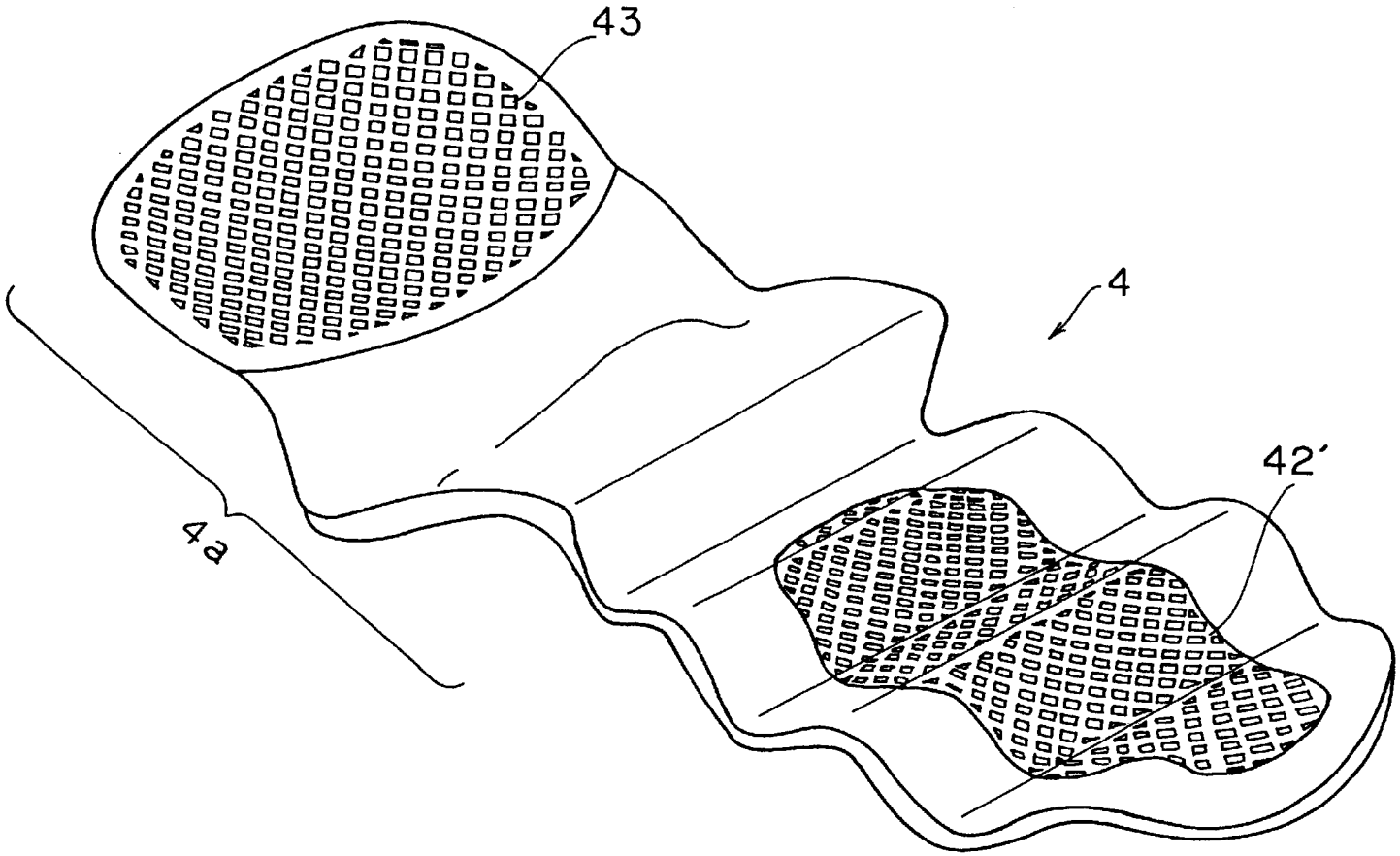
FIG. 11 is a perspective view of a corrugated sheet in the midsole construction of the seventh embodiment of the present invention.

FIGS. 10 and 11 show the midsole assembly of the seventh embodiment of the present invention. FIG. 10 is a perspective view of the midsole assembly, and FIG. 11 is a perspective view of the corrugated sheet.

In this seventh embodiment, a plurality of holes are formed at the center of the heel portion and the tip portion of the front end portion 4*a* (or forefoot portion) of the corrugated sheet 4. The heel central portion and the tip portion of the front end portion 4*a* are thus meshed.

By forming these meshed portions 42' and 43, cushioning properties on landing can be secured at the heel central portion, and flexibility of the forefoot portion with lower compressive hardness can be maintained and turnability of the forefoot portion can be improved.

In addition, holes formed in the tip portion of the front end portion 4*a* of the corrugated sheet 4 may be circular, rectangular, slit or any other shape.

In this seventh embodiment, a meshed portion 43 is formed in the tip portion of the front end portion 4*a* of the corrugated sheet 4 as shown in FIG. 10, but in this case, a meshed portion 42' in the heel central portion is not necessarily formed. Additionally, the current invention does not apply only to these examples. The meshed portion 43 may be formed in each tip portion of the front end portion 4*a* of the corrugated sheet 4 as shown in FIG. 7 or 9.

Moreover, in forming a meshed portion 43, a meshed sheet formed in another process may be injection molded together with the corrugated sheet 4. Alternatively, a meshed portion 43 may be formed by using a lower elasticity member than the corrugated sheet 4.

Figure 12:
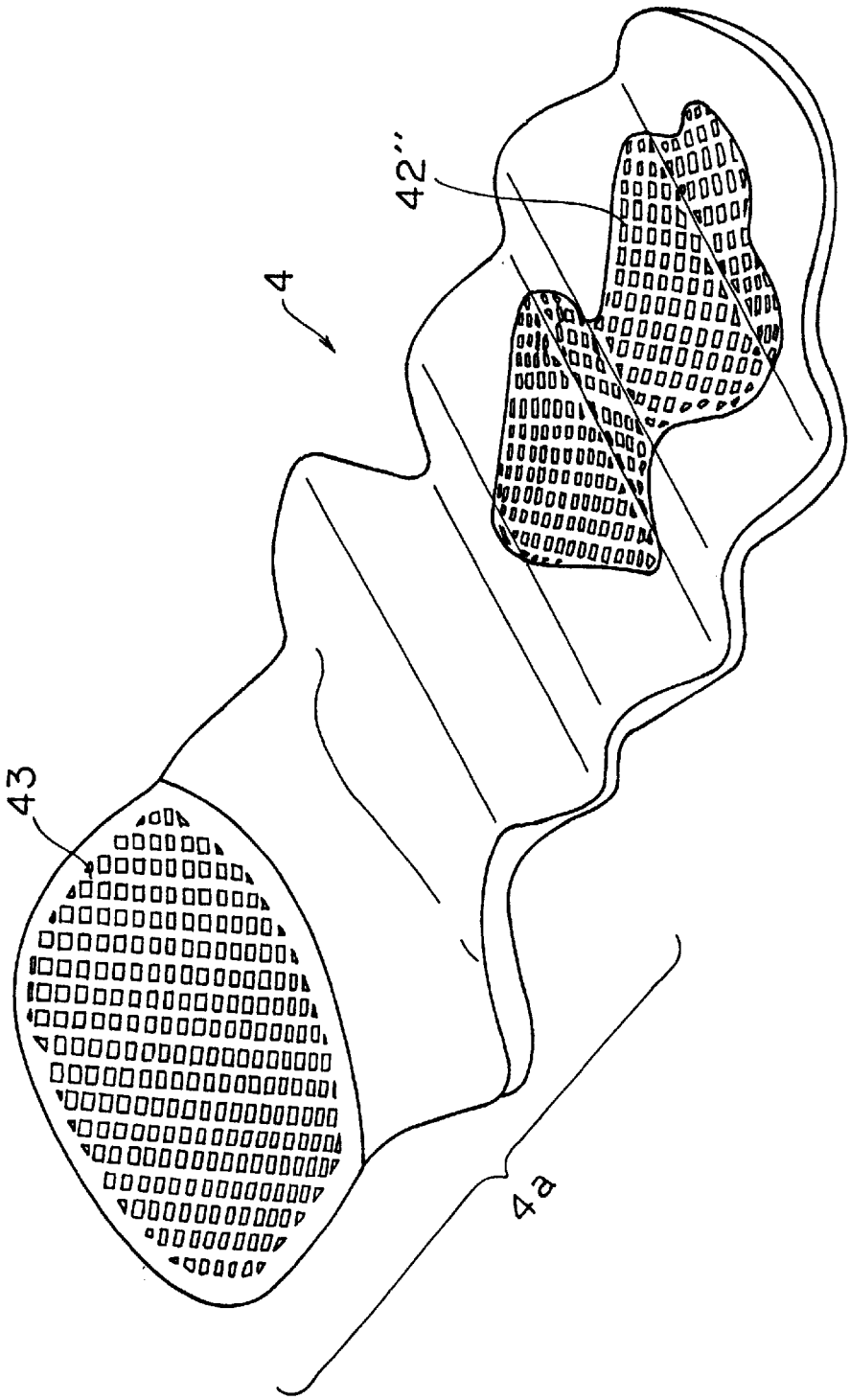
FIG. 12 is a schematic illustrating an alternative embodiment of FIG. 11.

The shape of the meshed portion 42' formed in the heel central portion of the corrugated sheet 4 is not limited to an elongated aperture as shown in FIGS. 8, 9 and 11. Various shapes such as a generally hourglass-shaped aperture as shown in FIG. 12 can be employed for meshed portion 42".

Figure 13:
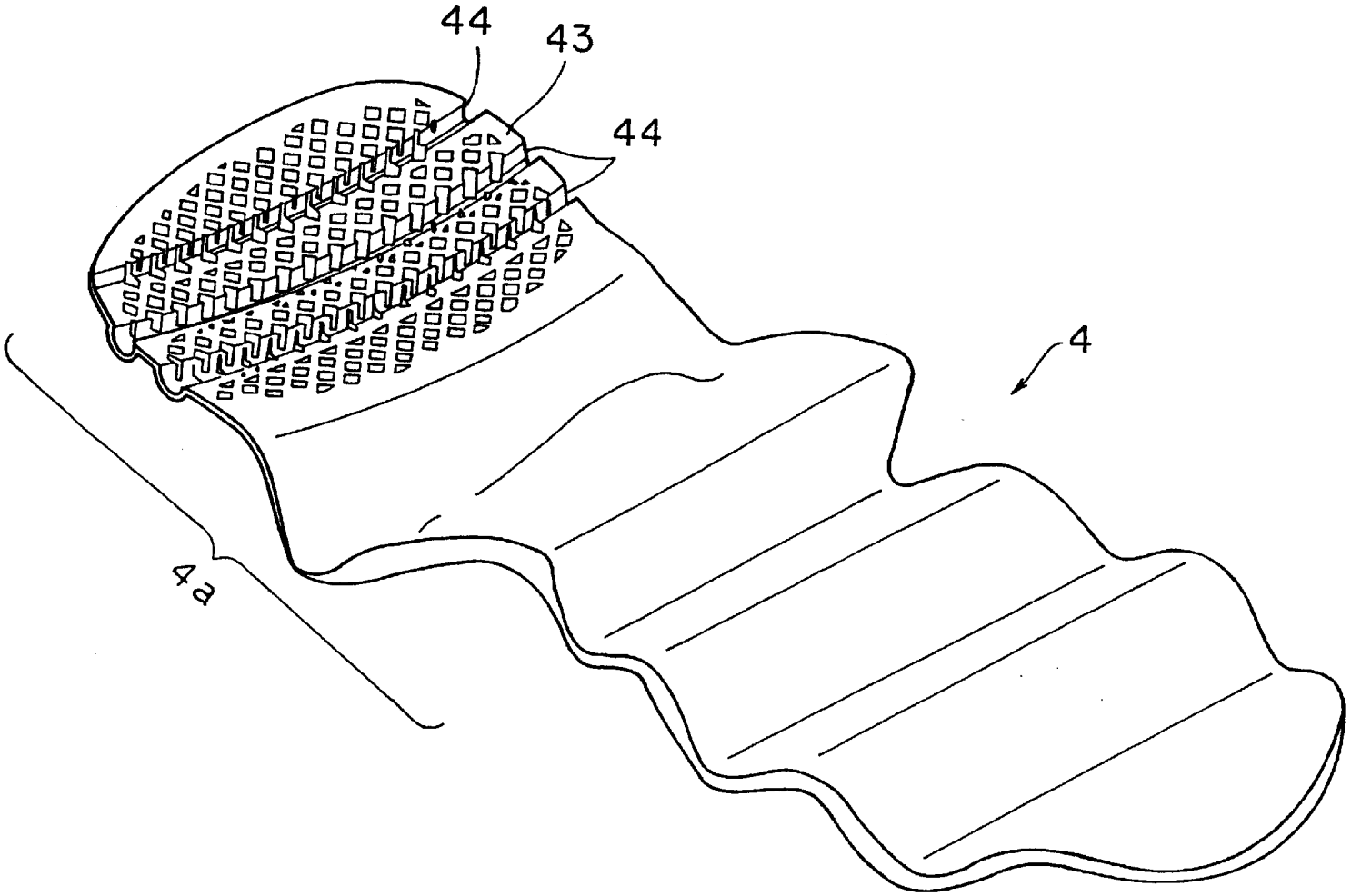
FIG. 13 is a perspective view of a corrugated sheet in the midsole construction of the eighth embodiment of the present invention.

FIG. 13 shows the corrugated sheet, which is employed in the midsole assembly of the eighth embodiment of the present invention.

In this eighth embodiment, a meshed portion 43 is formed on the tip portion of the front end portion 4*a* of the corrugated sheet 4 and a plurality of grooves 44 extending laterally are formed on the meshed portion 43. These grooves 44 improve further the flexibility of the forefoot portion of the midsole 3.

In addition, the grooves 44 formed on the front end portion 4*a* preferably are plural but a single groove may be adopted. Moreover, the meshed portion 43 is not necessarily formed on the tip portion of the front end portion 4*a* of the corrugated sheet 4.

Figure 14:
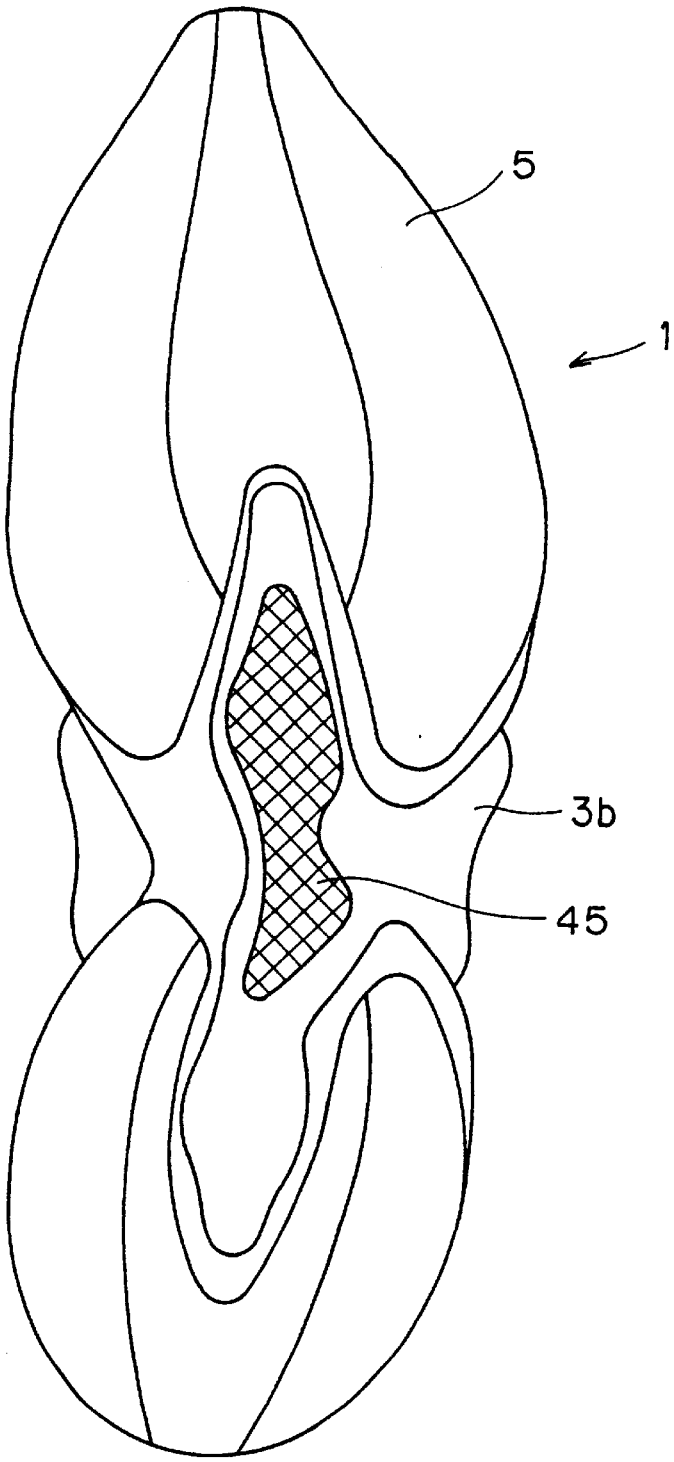
FIG. 14 is a bottom view of an athletic shoe incorporating the midsole construction of the ninth embodiment of the present invention.

FIG. 14 is a bottom view of the athletic shoe employing the midsole construction of the ninth embodiment of the present invention. In this ninth embodiment, a fiber reinforced plastic sheet 45, which extends longitudinally in a band form, is provided on the central portion of the plantar arch portion of the corrugated sheet 4.

This sheet 45 develops a so-called "shank effect" and thus, rigidity of the plantar arch portion can be improved. As a result, after landing, lateral deformation of the plantar arch portion of the midsole can be prevented and running stability can be secured.

The fiber reinforced plastic sheet 45 may be bonded to the corrugated sheet 4, or it may be injection molded together with the corrugated sheet 4.

A metal plate made of SUS, superelastic alloy, or the like can be substituted for the fiber reinforced plastic sheet 45. Furthermore, a sheet made from other plastic materials may be employed if it is a higher elastic member than the corrugated sheet 4. In addition, the fiber reinforced plastic sheet 45 may be placed covering the plantar arch portion.

In each of the second, third, fifth, sixth, seventh and eighth embodiments, a low elastic portion is formed of a plurality of holes, but the application of the current invention is not limited to these embodiments.

The low elastic portion may be formed of titanium itself or superelastic material itself such as titanium alloy. The titanium or superelastic material may be insert molded together with the corrugated sheet, and meshed or comprised of a plurality of fibers or plates of titanium or superelastic material.

Figure 15:
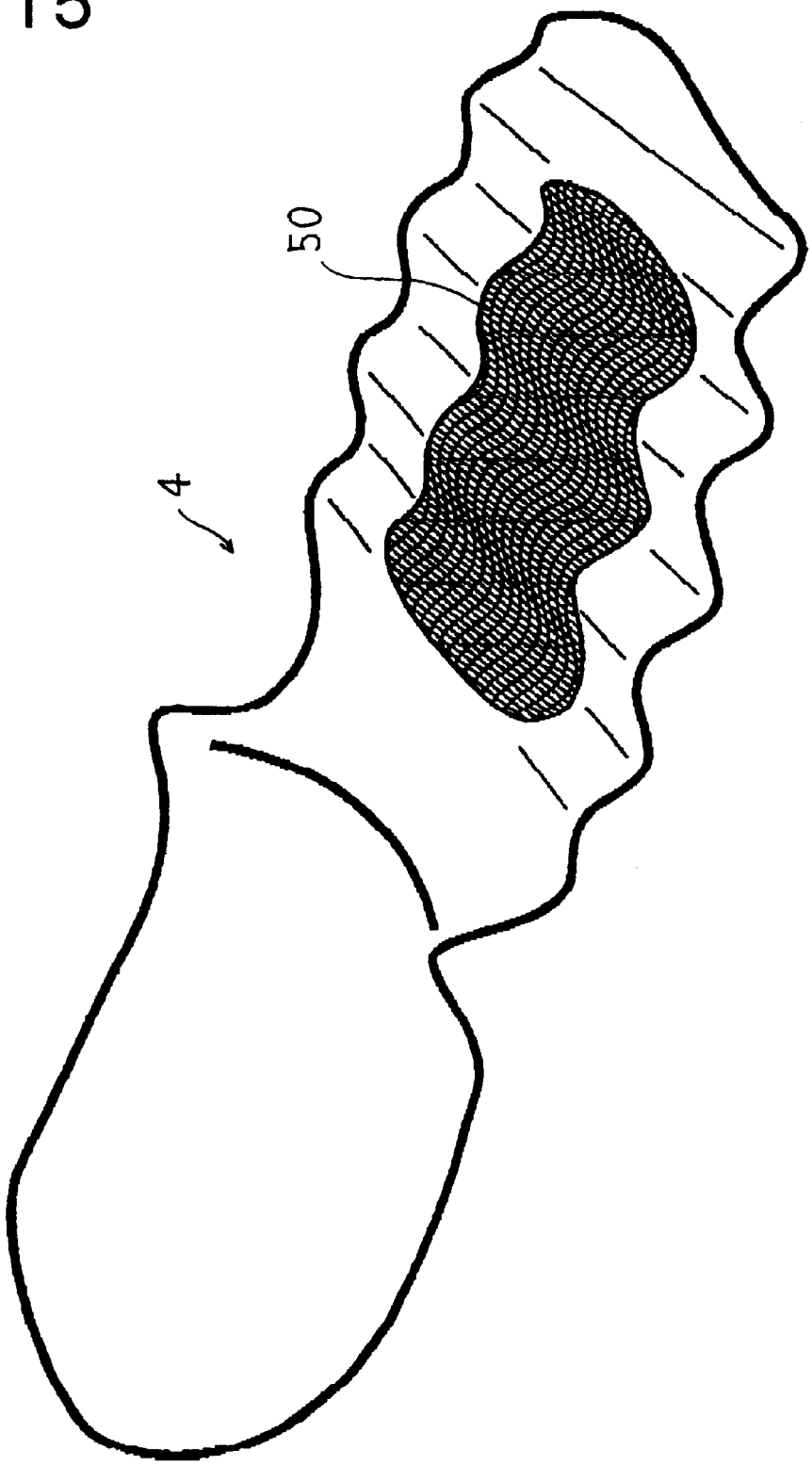
FIG. 15 is a perspective view of a corrugated sheet having a lower elastic portion formed of meshed titanium.

FIGS. 15 to 18 show a corrugated sheet of the present invention, respectively, which has a lower elastic portion in the heel central portion. In FIG. 15, the lower elastic portion

Figure 16:
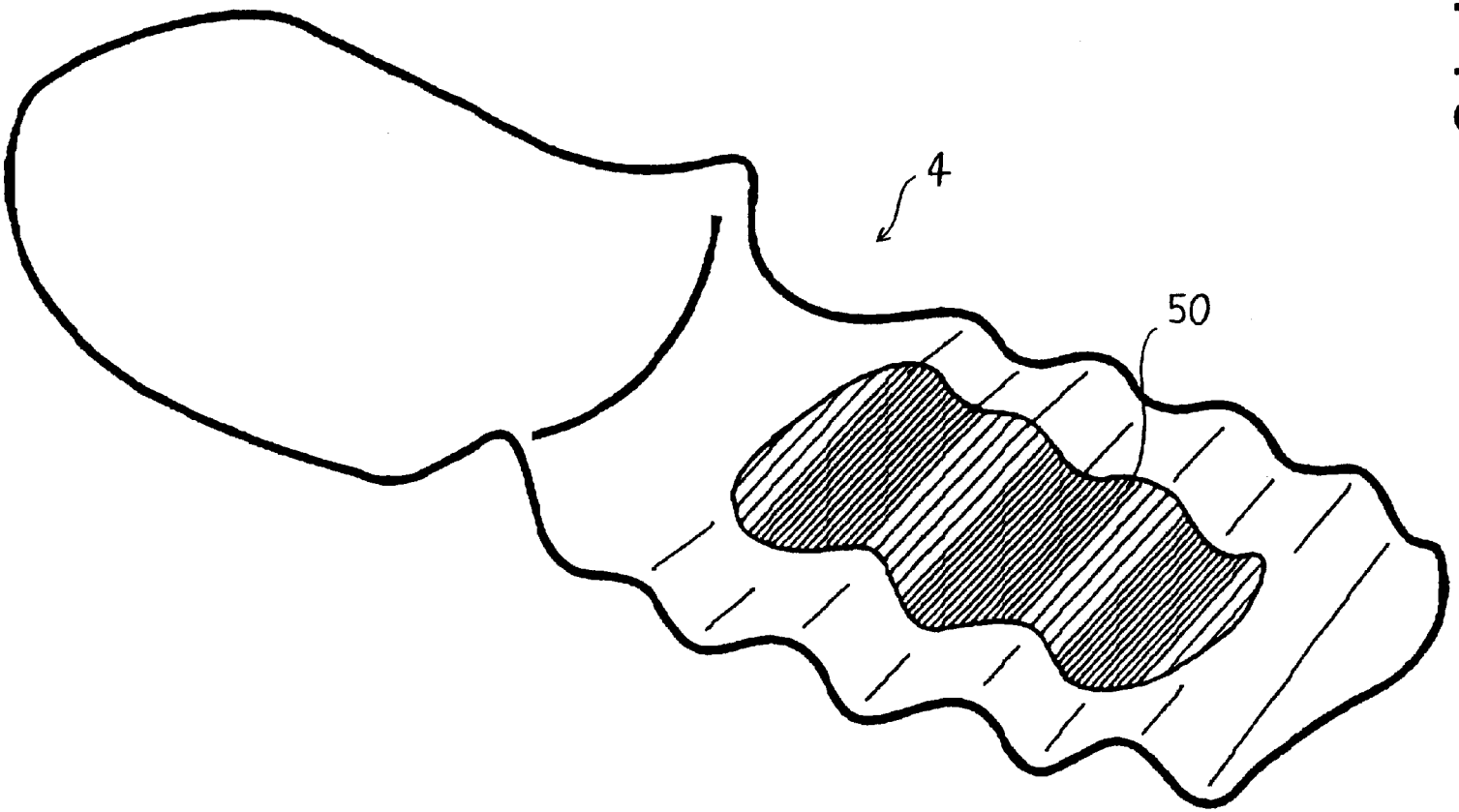
FIG. 16 is a perspective view of a corrugated sheet having a lower elastic portion formed of laterally extending titanium fibers.
Figure 17:
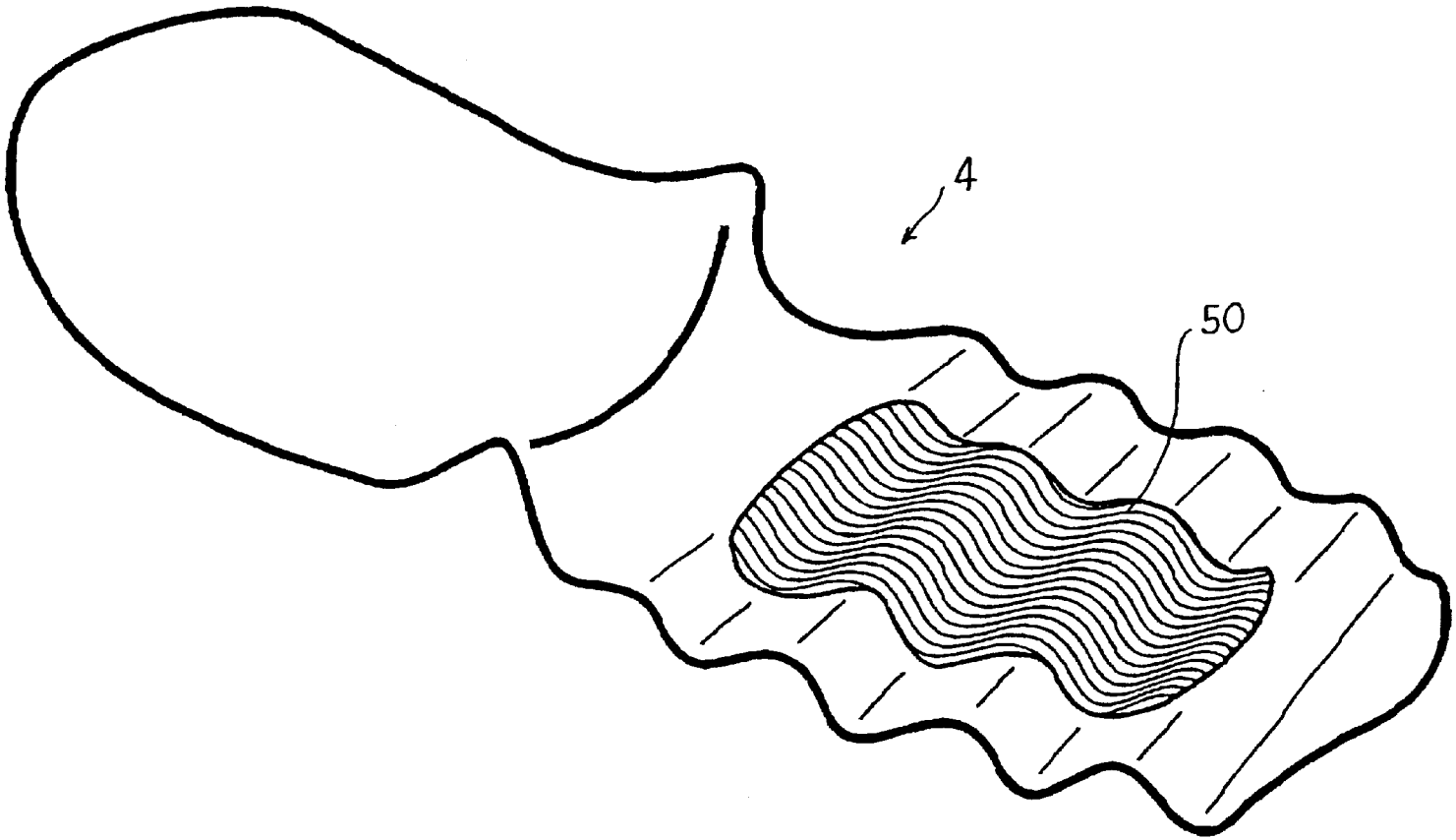
FIG. 17 is a perspective view of a corrugated sheet having a lower elastic portion formed of longitudinally extending titanium fibers.
Figure 18:
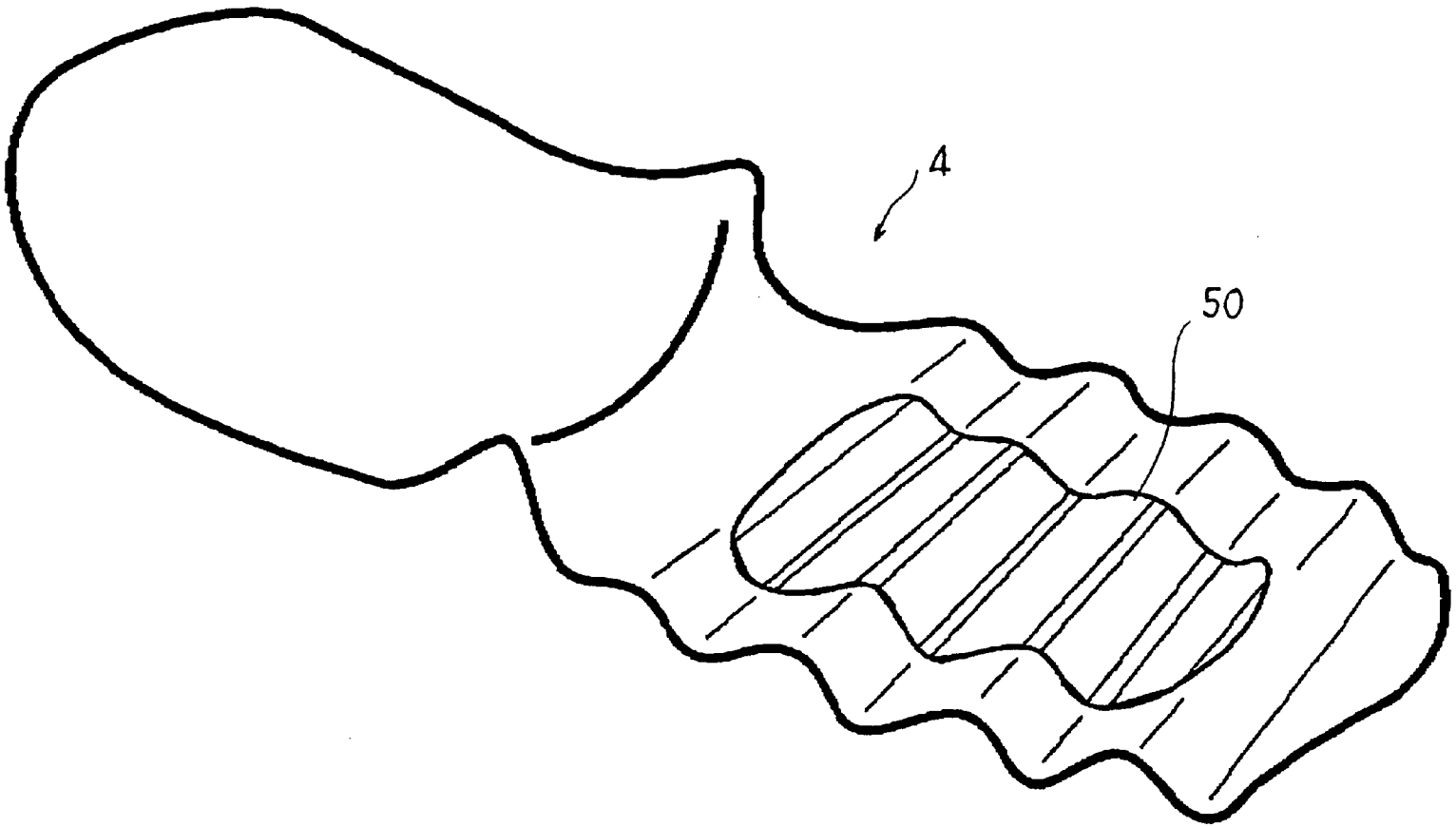
FIG. 18 is a perspective view of a corrugated sheet having a lower elastic portion formed of titanium plates.

50 is formed of meshed titanium. In FIGS. 16 and 17, the lower elastic portion 50 is formed of a plurality of titanium fibers. In FIG. 16, the titanium fibers extend laterally or in the shoe width direction, and in FIG. 17, the titanium fibers extend longitudinally or in the length direction. In FIG. 18, the lower elastic portion 50 is formed of a plurality of titanium plates.

Those skilled in the art to which the invention pertains may make modifications and other embodiments employing the principles of this invention without departing from its spirit or essential characteristics particularly upon considering the foregoing teachings. The described embodiments and examples are to be considered in all respects only as illustrative and not restrictive. The scope of the invention is, therefore, indicated by the appended claims rather than by the foregoing description. Consequently, while the invention has been described with reference to particular embodiments and examples, modifications of structure, sequence, materials and the like that would be apparent to those skilled in the art, still fall within the scope of the invention.

What is claimed is:

1. A midsole assembly for an athletic shoe comprising:

a midsole that is formed of a soft elastic material, and includes a midsole heel portion;

a corrugated sheet that is formed of a plastic resin, and includes a corrugated sheet heel portion disposed in said midsole heel portion; and a higher elastic member that has a higher modulus of elasticity than said corrugated sheet, and is arranged along an outer circumferential portion of said corrugated sheet heel portion.

2. The midsole assembly for an athletic shoe of claim 1, wherein said higher elastic member comprises a sheet of fiber-reinforced plastic.

3. The midsole assembly for an athletic shoe of claim 1, wherein said higher elastic member comprises a metal plate.

4. The midsole assembly for an athletic shoe of claim 1, wherein said higher elastic member is bonded to said corrugated sheet.

5. The midsole assembly for an athletic shoe of claim 1, wherein said higher elastic member is injection molded with said corrugated sheet.

6. The midsole assembly for an athletic shoe of claim 1, wherein said corrugated sheet consists of said corrugated sheet heel portion and is disposed only in said midsole heel portion.

7. The midsole assembly for an athletic shoe of claim 1, wherein:

said midsole further includes a midsole plantar arch portion extending from said midsole heel portion, and a midsole forefoot portion extending from said midsole plantar arch portion;

said corrugated sheet further includes a corrugated sheet front end portion that extends from said corrugated sheet heel portion along said midsole plantar arch portion and said midsole forefoot portion; and said higher elastic member is further arranged to extend from said outer circumferential portion of said corrugated sheet heel portion to and along said corrugated sheet front end portion proximate to said midsole plantar arch portion.

8. The midsole assembly for an athletic shoe of claim 7, wherein said higher elastic member comprises a sheet of fiber-reinforced plastic.

9. The midsole assembly for an athletic shoe of claim 7, wherein said higher elastic member comprises a metal plate.

10. The midsole assembly for an athletic shoe of claim 7, wherein said higher elastic member is bonded to said corrugated sheet.

11. The midsole assembly for an athletic shoe of claim 7, wherein said higher elastic member is injection molded with said corrugated sheet.

12. The midsole assembly for an athletic shoe of claim 7, wherein said corrugated sheet heel portion includes said outer circumferential portion and a central portion that is at least partially circumferentially surrounded by said outer circumferential portion, and wherein said midsole assembly further comprises a lower elastic portion that has a lower modulus of elasticity than said corrugated sheet and is arranged at said central portion of said corrugated sheet heel portion.

13. The midsole assembly for an athletic shoe of claim 1, wherein said corrugated sheet heel portion includes said outer circumferential portion and a central portion that is at least partially circumferentially surrounded by said outer circumferential portion, and wherein said midsole assembly further comprises a lower elastic portion that has a lower modulus of elasticity than said corrugated sheet and is arranged at said central portion of said corrugated sheet heel portion.

14. A midsole assembly for an athletic shoe comprising:

a midsole that is formed of a soft elastic material, and includes a midsole heel portion;

a corrugated sheet that is formed of a plastic resin, and includes a corrugated sheet heel portion disposed in said midsole heel portion; and a lower elastic portion that has a lower modulus of elasticity than said corrugated sheet, and is arranged at a center area of said corrugated sheet heel portion and integrally connected to said corrugated sheet heel portion.

15. The midsole assembly for an athletic shoe of claim 14, wherein said lower elastic portion is arranged only at said center area and not at an outer circumferential portion of said corrugated sheet heel portion that at least partly circumferentially surrounds said center area.

16. The midsole assembly for an athletic shoe of claim 14, wherein said lower elastic portion includes a plurality of holes formed in said corrugated sheet.

17. The midsole assembly for an athletic shoe of claim 14, wherein said lower elastic portion comprises a meshed sheet that is injection molded with said corrugated sheet.

18. The midsole assembly for an athletic shoe of claim 14, wherein said lower elastic portion comprises titanium.

19. The midsole assembly for an athletic shoe of claim 18, wherein said titanium is insert molded with said corrugated sheet.

20. The midsole assembly for an athletic shoe of claim 19, wherein said titanium is meshed, or comprises a plurality of fibers or plates of titanium.

21. The midsole assembly for an athletic shoe of claim 14, wherein said lower elastic portion comprises a superelastic material.

22. The midsole assembly for an athletic shoe of claim 21, wherein said superelastic material is insert molded with said corrugated sheet.

23. The midsole assembly for an athletic shoe of claim 22, wherein said superelastic material is meshed, or comprises a plurality of fibers or plates of said superelastic material.

24. The midsole assembly for an athletic shoe of claim 14, wherein said corrugated sheet consists of said corrugated sheet heel portion and is disposed only in said midsole heel portion.

25. The midsole assembly for an athletic shoe of claim 14, wherein:

said midsole further includes a midsole plantar arch portion extending from said midsole heel portion, and a midsole forefoot portion extending from said midsole plantar arch portion; and said corrugated sheet further includes a corrugated sheet front end portion that extends from said corrugated sheet heel portion along said midsole plantar arch portion and said midsole forefoot portion.

26. The midsole assembly for an athletic shoe of claim 25, wherein said lower elastic portion includes a plurality of holes formed in said corrugated sheet.

27. The midsole assembly for an athletic shoe of claim 25, wherein said lower elastic portion comprises a meshed sheet that is injection molded with said corrugated sheet.

28. The midsole assembly for an athletic shoe of claim 25, wherein said lower elastic portion comprises titanium.

29. The midsole assembly for an athletic shoe of claim 28, wherein said titanium is insert molded with said corrugated sheet.

30. The midsole assembly for an athletic shoe of claim 29, wherein said titanium is meshed, or comprises a plurality of fibers or plates of titanium.

31. The midsole assembly for an athletic shoe of claim 25, wherein said lower elastic portion comprises a superelastic material.

32. The midsole assembly for an athletic shoe of claim 31, wherein said superelastic material is insert molded with said corrugated sheet.

33. The midsole assembly for an athletic shoe of claim 32, wherein said superelastic material is meshed, or comprises a plurality of fibers or plates of said superelastic material.

34. A midsole assembly for an athletic shoe comprising:

a midsole that is formed of a soft elastic material, and includes a midsole heel portion, a midsole plantar arch portion extending from said midsole heel portion, and a midsole forefoot portion extending from said midsole plantar arch portion;

a corrugated sheet that is formed of a plastic resin, and includes a corrugated sheet heel portion disposed in said midsole heel portion, a corrugated sheet plantar arch portion that extends from said corrugated sheet heel portion along said midsole plantar arch portion, and a corrugated sheet forefoot portion that extends from said corrugated sheet plantar arch portion along said midsole forefoot portion; and a lower elastic portion that has a lower modulus of elasticity than said corrugated sheet, and is arranged at said corrugated sheet forefoot portion and integrally connected to said corrugated sheet forefoot portion.

35. The midsole assembly for an athletic shoe of claim 34, wherein said lower elastic portion includes a plurality of holes formed in said corrugated sheet.

36. The midsole assembly for an athletic shoe of claim 34, wherein said lower elastic portion comprises a meshed sheet that is injection molded with said corrugated sheet.

37. The midsole assembly for an athletic shoe of claim 34, wherein said lower elastic portion comprises titanium.

38. The midsole assembly for an athletic shoe of claim 37, wherein said titanium is insert molded with said corrugated sheet.

39. The midsole assembly for an athletic shoe of claim 38, wherein said titanium is meshed, or comprises a plurality of fibers or plates of titanium.

40. The midsole assembly for an athletic shoe of claim 34, wherein said lower elastic portion comprises a superelastic material.

41. The midsole assembly for an athletic shoe of claim 40, wherein said superelastic material is insert molded with said corrugated sheet.

42. The midsole assembly for an athletic shoe of claim 41, wherein said superelastic material is meshed, or comprises a plurality of fibers or plates of said superelastic material.

43. The midsole assembly for an athletic shoe of claim 34, wherein said corrugated sheet forefoot portion includes therein a groove extending in a lateral direction.

44. A midsole assembly for an athletic shoe comprising:

a midsole that is formed of a soft elastic material, and includes a midsole heel portion, a midsole plantar arch portion extending from said midsole heel portion, and a midsole forefoot portion extending from said midsole plantar arch portion;

a corrugated sheet that is formed of a plastic resin, and includes a corrugated sheet heel portion disposed in said midsole heel portion, a corrugated sheet plantar arch portion that extends from said corrugated sheet heel portion along said midsole plantar arch portion, and a corrugated sheet forefoot portion that extends from said corrugated sheet plantar arch portion along said midsole forefoot portion; and a higher elastic member that has a modulus of elasticity higher than said corrugated sheet and is arranged at said corrugated sheet plantar arch portion.

45. The midsole assembly for an athletic shoe of claim 44, wherein said higher elastic member comprises a sheet of fiber-reinforced plastic.

46. The midsole assembly for an athletic shoe of claim 44, wherein said higher elastic member comprises a metal plate.

47. The midsole assembly for an athletic shoe of claim 44, wherein said higher elastic member is bonded to said corrugated sheet.

48. The midsole assembly for an athletic shoe of claim 44, wherein said higher elastic member is injection molded with said corrugated sheet.

49. The midsole assembly for an athletic shoe of claim 44, wherein said higher elastic member extends in a band shape in a longitudinal direction of said corrugated sheet plantar arch portion.

50. The midsole assembly for an athletic shoe of claim 44, wherein said higher elastic member covers said corrugated sheet plantar arch portion.

* * * * *